US012807882B2

(12) United States Patent
Littlewood et al.

(10) Patent No.: US 12,807,882 B2
(45) Date of Patent: Nov. 24, 2026

(54) PERFORMANCE IMPROVEMENTS IN THE PRODUCTION OF LIQUEFIED PETROLEUM GAS (LPG) HYDROCARBONS FROM SYNTHESIS GAS

(71) Applicant: GTI Energy, Des Plaines, IL (US)

(72) Inventors: Patrick Littlewood, Chicago, IL (US); Terry Marker, Park Ridge, IL (US); Michael Bradford, Des Plaines, IL (US)

(73) Assignee: GTI Energy, Des Plaines, IL (US)

( * ) Notice: Subject to any disclaimer, the term of this patent is extended or adjusted under 35 U.S.C. 154(b) by 217 days.

(21) Appl. No.: 18/407,880

(22) Filed: Jan. 9, 2024

(65) Prior Publication Data

US 2025/0223502 A1 Jul. 10, 2025

(51) Int. Cl.
*C07C 1/04* (2006.01)
*C10G 2/00* (2006.01)

(52) U.S. Cl.
CPC ..... *C10G 2/334* (2013.01); *C10G 2/333* (2013.01); *C10G 2300/4037* (2013.01);
(Continued)

(58) Field of Classification Search
CPC ..... C10G 2/333; C10G 2/334; C10G 2300/4037; C10G 2300/4081;
(Continued)

(56) References Cited

U.S. PATENT DOCUMENTS 4,310,440 A 1/1982 Wilson et al.
4,440,871 A 4/1984 Lok et al.
(Continued)

FOREIGN PATENT DOCUMENTS

CN 105132063 A 12/2015
CN 110846096 A 2/2020
(Continued)

OTHER PUBLICATIONS

Lavoie, Jean-Michel, "Review on dry reforming of methane, a potentially more environmentally-friendly approach to the increasing natural gas exploitation", Frontiers In Chemistry, vol. 2 (81): 1-17, Nov. 2014.
(Continued)

*Primary Examiner* — In Suk C Bullock
*Assistant Examiner* — Jason Y Chong
(74) *Attorney, Agent, or Firm* — Banner & Witcoff, Ltd.

(57) ABSTRACT

Processes are disclosed for the production of liquefied petroleum gas (LPG) hydrocarbons, utilizing both alcohol (e.g., methanol) synthesis and in situ dehydration of the alcohol to hydrocarbons, and particularly propane and/or butane. The strategic implementation of water and/or heat removal, as well as adjustments to amounts of water and/or heat removed, have been discovered to result in important process improvements, such as in the performance of catalyst systems used in these processes. Performance advantages may reside, for example, in increased LPG hydrocarbon yield and/or selectivity, increased catalyst stability, or, for a given LPG synthesis reactor, decreased exotherm and/or decreased maximum temperature. Performance parameters associated with reduced reaction temperatures may advantageously facilitate the use of a wider selection of reaction systems, such as a fluidized bed reactor, which may further improve material and heat distribution, and therefore overall process control.

20 Claims, 6 Drawing Sheets

(52) U.S. Cl.
CPC . *C10G 2300/4081* (2013.01); *C10G 2300/70* (2013.01); *C10G 2400/28* (2013.01)

(58) Field of Classification Search
CPC .. C10G 2300/70; C10G 2400/28; C07C 1/04; C07C 1/12; C10L 2290/06; C10L 2290/08; C10L 2290/10; C10L 2290/46; C10L 3/12
See application file for complete search history.

(56) References Cited

U.S. PATENT DOCUMENTS

| | | | | |
|---|---|---|---|---|
| 4,554,143 | A | 11/1985 | Messina et al. | |
| 4,752,651 | A | 6/1988 | Kaiser | |
| 4,793,984 | A | 12/1988 | Lok et al. | |
| 4,853,197 | A | 8/1989 | Wilson et al. | |
| 5,126,308 | A | 6/1992 | Barger et al. | |
| 5,191,141 | A | 3/1993 | Barger et al. | |
| 8,901,178 | B2 | 12/2014 | Rabovitser et al. | |
| 9,145,300 | B1 | 9/2015 | Foody | |
| 9,605,286 | B2 | 3/2017 | Foody | |
| 10,738,247 | B2 | 8/2020 | Marker et al. | |
| 10,906,808 | B2 | 2/2021 | Marker et al. | |
| 2006/0124445 | A1 | 6/2006 | Labrecque et al. | |
| 2007/0282019 | A1* | 12/2007 | Fujimoto | B01J 29/44 518/715 |
| 2013/0210096 | A1 | 8/2013 | Schultz et al. | |
| 2013/0256093 | A1 | 10/2013 | Ishiwata et al. | |
| 2014/0028958 | A1 | 1/2014 | Lin et al. | |
| 2019/0076828 | A1 | 3/2019 | Almusaiteer et al. | |
| 2019/0352239 | A1 | 11/2019 | Nieskens et al. | |
| 2020/0087144 | A1 | 3/2020 | Marker et al. | |
| 2020/0087576 | A1 | 3/2020 | Marker et al. | |

FOREIGN PATENT DOCUMENTS

| | | | |
|---|---|---|---|
| EP | 0146165 | A2 | 6/1985 |
| JP | 2007238608 | A | 9/2007 |
| JP | 2009195815 | A | 9/2009 |
| KR | 20190134236 | A | 12/2019 |
| WO | 2004076600 | A1 | 9/2004 |
| WO | 2005037962 | A1 | 4/2005 |
| WO | 2007065905 | A1 | 6/2007 |
| WO | 2012142950 | A1 | 10/2012 |

OTHER PUBLICATIONS

Asami, Kenji et al., "Selective synthesis of LPG from synthesis gas", Studies in Surface Science and Catalysts, 147, pp. 427-432, (2004).

Zhang, Qianwen et al., "Synthesis of LPG from synthesis gas", Fuel Processing Technology, 85, pp. 1139-1150, (2004).

Ge, Qingjie, et al., "Direct synthesis of LPG from synthesis gas over Pd—Zn—Cr/Pd-ß hybrid catalysts", Journal of Molecular Catalysis A: Chemical 278, pp. 215-219, (2007).

Dec. 19, 2022—(WO) International Search Report and Written Opinion—App PCT/US2022/076047.

Oct. 23, 2024—(WO) International Search Report and Written Opinion—App PCT/US2024/038339.

Apr. 16, 2025—(WO) (ISA/206) Invitation to Pay Additional Fees and Partial International Search Report and Written Opinion—App PCT/US2025/010888.

Jun. 10, 2025—(WO) International Search Report and Written Opinion—App PCT/US2025/010888.

Oct. 24, 2023—(WO) International Search Report and Written Opinion—App PCT/US2023/026934.

Li Congming et al: "Direct synthesis of LPG from carbon dioxide over hybrid catalysts comprising modified methanol synthesis catalyst and [beta]-type zeolit", Applied Catalysis A: General, Elsevier, Amsterdam, Nl, vol. 475, Jan. 21, 2014 (Jan. 21, 2014), pp. 155-160, XP028845492, ISSN: 0926-860X, DOI: 10.1016/J.APCATA.2014.01.025 p. 155, right-hand column, paragraph 2.1—p. 156, left-hand column, paragraph 1 p. 156, left-hand column, paragraph 2.3; table 1 p. 157, right-hand column, paragraph 3.5.1.

* cited by examiner

PERFORMANCE IMPROVEMENTS IN THE PRODUCTION OF LIQUEFIED PETROLEUM GAS (LPG) HYDROCARBONS FROM SYNTHESIS GAS

FIELD OF THE INVENTION

Aspects of the invention relate to performance improvements that may be realized in processes for the conversion of synthesis gas comprising $H_2$ and CO to products comprising propane and/or butane, for example by the removal of water and/or heat from such processes.

DESCRIPTION OF RELATED ART

The ongoing search for alternatives to crude oil, as a conventional source of carbon for hydrocarbon products, is increasingly driven by a number of factors. These include diminishing petroleum reserves, higher anticipated energy demands, and heightened concerns over greenhouse gas (GHG) emissions from sources of non-renewable carbon. Hydrocarbon products of greatest industrial significance and interest, in terms of having their carbon content replaced with non-petroleum derived carbon, include transportation and heating fuels as well as precursors for specialty chemicals. The particular hydrocarbons propane and/or butane are present in many of these products, a common example of which is liquefied petroleum gas (LPG).

A key commercial process for converting methane, biomass, coal, or other carbonaceous feedstocks into fuels involves a first conversion step to produce synthesis gas (syngas), followed by a second, downstream Fischer-Tropsch (FT) conversion step. With respect to the first conversion step, known processes for the production of syngas include partial oxidation reforming and autothermal reforming (ATR), based on the exothermic oxidation of methane with oxygen. Steam methane reforming (SMR), in contrast, uses steam as the oxidizing agent, such that the thermodynamics are significantly different, not only because the production of steam itself can require an energy investment, but also because reactions involving methane and water are endothermic. More recently, it has also been proposed to use carbon dioxide as the oxidizing agent for methane, such that the desired syngas is formed by the reaction of carbon in its most oxidized form ($CO_2$) with carbon in its most reduced form ($CH_4$). This reaction has been termed the "dry reforming" of methane, and because it is highly endothermic, thermodynamics for the dry reforming of methane are less favorable compared to ATR or even SMR. Gasification and pyrolysis have also been in extensive use for converting both renewable and non-renewable sources of carbon (e.g., biomass and coal) into syngas. A technology for processing diverse types of solid feedstocks including biomass, municipal solid waste, and plastics, which yields syngas in combination with deoxygenated hydrocarbon products suitable for use as gasoline and/or diesel fuel, is known as hydropyrolysis and is described in U.S. Pat. Nos. 8,492,600 and 10,619,105, as well as other patents assigned to Gas Technology Institute (Des Plaines, IL).

With respect to the second step involving FT conversion, synthesis gas containing a mixture of hydrogen and carbon monoxide (CO) is subjected to successive cleavage of C—O bonds and formation of C—C bonds with the incorporation of hydrogen. This mechanism provides for the formation of hydrocarbons, and particularly straight-chain alkanes with a distribution of molecular weights that can be controlled to some extent by varying the FT reaction conditions (e.g., temperature, pressure, space velocity, and feed $H_2$:CO ratio) and catalyst properties. Such properties include pore size and other characteristics of the support material. The choice of catalyst can impact FT product yields in other respects. For example, iron-based FT catalysts tend to produce more oxygenates, whereas ruthenium as the active metal tends to produce exclusively paraffins. The reaction pathways of FT synthesis follow a statistical kinetic model, which leads to hydrocarbons having an Anderson-Schultz-Flory distribution of their carbon numbers. In the case of targeting the $C_3$ and $C_4$ hydrocarbons, i.e., propane and butane, this generally involves operating in a low conversion regime with a significant co-production of methane and ethane. Higher conversions, on the other hand, generate $C_5^+$ hydrocarbons that are liquid at room temperature. Additional potential routes for the production of LPG hydrocarbons from syngas are described by K. Asami et al. (Studies in Surface Science and Catalysis 147 (2004) 427-432); Q. Zhang et al. (Fuel Processing Technology 85 (2004) 1139-1150); and Q. Ge et al. (Journal of Molecular Catalysis A: Chemical 278 (2007) 215-219.

In terms of known pathways offering the potential for producing LPG hydrocarbons from synthesis gas, which is desirably derived from renewable methane (e.g., present in biogas) or biomass, improvements are needed in a number of areas. These include reaction product selectivity and yield, catalyst stability, temperature control, and reactor type flexibility, all of which parameters significantly impact commercial viability. Overall, the state of the art would benefit from technologies for the efficient conversion of industrially available sources of synthesis gas, whether obtained as a standalone feed or from an upstream processing stage (e.g., a reforming stage) of an integrated process, to products comprising propane and/or butane. Industrially relevant examples of such products are those having a composition approximating that of liquefied petroleum gas (LPG). With respect to the practical impact of such technologies, a current objective of a number of countries around the world is to reduce deforestation and the generation of pollution, both of which result from the burning of wood for heating and cooking. However, because of the remoteness of many locations and the associated, long transportation routes, petroleum-derived LPG is priced at a premium and therefore not considered, from a cost standpoint, an acceptable alternative to wood. Accordingly, a number of significant advantages could be gained by efficiently obtaining LPG hydrocarbons from renewable resources that provide synthesis gas. These advantages include freedom from the need to import petroleum-derived LPG, a reduction in GHG emissions, improvement in air quality, and the potential stimulation of local economies, particularly in poorer regions.

SUMMARY OF THE INVENTION

Aspects of the invention are associated with the discovery of processes for producing liquefied petroleum gas (LPG) from a synthesis gas feed, and the manner in which such processes are operated. Representative processes provide, through reactions of the synthesis gas feed, both alcohol (e.g., methanol) synthesis and in situ dehydration of the alcohol (e.g., methanol) to hydrocarbons, and particularly the LPG hydrocarbons propane and/or butane. Particular aspects relate to the strategic implementation of water and/or heat removal, as well as adjustments to amounts of water and/or heat removed, that surprisingly lead to process improvements, such as in the performance of catalyst systems used in these processes. Performance advantages may reside, for example, in increased yield and/or selectivity, increased stability, decreased exotherm, and/or decreased maximum temperature in a given LPG synthesis reactor. Performance parameters associated with reduced exotherm/reaction temperatures may advantageously facilitate the use of a wider selection of reaction systems, such as a fluidized bed reactor, which may further improve material and heat distribution, and therefore overall process control. Problems that might otherwise arise due to catalyst instability, such as the need for frequent replacement and/or regeneration, may thereby be potentially reduced or even eliminated.

For example, known processes for the conversion of methanol to olefinic hydrocarbons (methanol-to-olefins, or MTO, processes) using solid acid catalysts require continuous catalyst regeneration (CCR) to address the problem of rapid catalyst coking. Due to stability improvements associated with the manner in which LPG synthesis catalyst systems are implemented, as described herein, in representative embodiments these catalyst systems may be utilized in a fixed bed configuration, or otherwise in an alternative bed configuration (e.g., as a fluidized bed), but without continuous catalyst regeneration. In any event, those skilled in the art will appreciate that even modest increases in catalyst stability, selectivity, and/or per-pass yield will generally translate to very significant economic benefits on a commercial scale. In addition to relaxed requirements for catalyst regeneration, such benefits may be attributed, for example, to a decreased formation of undesired byproducts, including catalyst coke precursors, and/or reduced recycle gas requirements. Relevant to all of these desired improvements, the ability to lower operating temperature is often instrumental in avoiding non-selective side reactions that lead to coking and that are detrimental to catalyst stability.

Particular aspects of the invention relate to the discovery of improvements in performance parameters, including those described above, which are relevant for the conversion of synthesis gas to LPG hydrocarbons. Such improvements have been found to result from the removal of water and/or heat from processes utilizing catalyst systems described herein for such conversion. Advantageously, by the strategic removal of water from processes for converting synthesis gas, including mixtures of CO and/or $CO_2$ with $H_2$, to LPG hydrocarbons, the overall degree of non-selective, or undesirable, conversion of CO to $CO_2$ can be mitigated or possibly even eliminated, and carbon present in $CO_2$ itself can be utilized in the formation of propane and/or butane. According to particular embodiments, water or a water-enriched product can be removed between reactors, such as between first and second, respective upstream and downstream, LPG synthesis reactors of an LPG synthesis stage. The removal of heat, such as heat associated with water removal, between reactors configured in series, may be characteristic of a staged reactor system. Therefore, in the case of heat and/or water removal between two or more reactors of the LPG synthesis stage, such reactors may operate as staged reactors, having some degree of operational control (e.g., cooling and/or moisture removal) between stages. For example, in the case of two or more fixed bed reactors of an LPG synthesis stage, these may operate as staged adiabatic reactors and may, more particularly, utilize interstage cooling. Alternatively or in combination, water or a water-enriched product can be removed downstream of the LPG synthesis stage (or reactor of this stage), such as from the total effluent exiting this stage (or reactor), or possibly from a recycle portion of this effluent, for example in the case of a loop reactor employing such recycle back to LPG synthesis stage (or reactor of this stage). Yet further processing options reside in removing water or a water-enriched product upstream of the LPG synthesis stage, for example by removing an initial water-enriched product from the synthesis gas feed or, more specifically, from a fresh makeup feed that may provide at least a portion of the synthesis gas feed.

Whether a water-enriched product is removed between reactors, upstream of, or downstream of, the LPG synthesis stage, this may be performed by cooling to condense this product, for example using an inter-reactor cooler or loop reactor cooler, by adsorption of moisture from the gas phase, and/or by membrane separation. Often, cooling at pressure (i.e., without pressure loss, or with only minimal pressure loss), in conjunction with the separation of condensed water, such as by using a knockout pot, provides a simple and effective method for removal of a water-enriched product. In the case of downstream removal, this also extends to embodiments in which separations performed in a separation stage, to resolve the LPG product and optionally other fractions, such as a gaseous fraction and/or a heavy byproduct fraction, are likewise used to resolve the water-enriched product. According to a specific embodiment, a loop reactor employing recycle of a portion of the LPG effluent, produced in the LPG synthesis stage, facilitates the use of a fluidized bed reactor in view of the increased reactor throughput (e.g., due to operation at less than 100% conversion per pass) that provides favorable catalyst distribution and heat transfer characteristics. However, regardless of the particular reactor type, the combination of recycle operation and water removal, with its associated heat removal, may be beneficial in terms of controlling reactor temperature rise (exotherm) and overall heat management, leading to improved reaction selectivity to the desired LPG hydrocarbons. In some embodiments, one or more reactors of an LPG synthesis stage may be fixed bed reactors, such as, more particularly, adiabatic fixed bed reactors.

Other particular aspects of the invention relate to the discovery of effective solutions for addressing water formation that necessarily accompanies the conversion of synthesis gas to alkane hydrocarbons, as a consequence of oxygen removal that is a requirement of the reaction chemistry or chemical pathway. Water formed as a byproduct can be converted, in turn, via the water-gas shift (WGS) reaction with CO present in the synthesis gas to produce $CO_2$. This relatively stable product may in this case be considered to have resulted from the non-selective "use" of feed carbon. With respect to many catalyst systems that are relevant to alcohol-mediated alkane formation routes, equilibrium $CO_2$ levels are established rapidly, thereby reducing carbon utilization in this manner, for the formation of LPG hydrocarbons. Whereas the recycling of $CO_2$ and $H_2$ can aid in the suppression of excessive equilibrium concentrations of these WGS products, it has been found that the removal of excess oxygen, by the removal of water, can likewise lead to selectivity and carbon utilization advantages, but to even a greater degree, whether or not combined with recycle. In the specific case of being combined with water removal, the recycle of water-depleted LPG synthesis effluent as a gas flow over the LPG synthesis catalyst system can, in some cases, effectively eliminate any net production of $CO_2$ byproduct and in fact lead to its net consumption in LPG hydrocarbon-forming reactions. Advantageously, this can be achieved without a requirement for significant depressurization of the recycle stream, and with the added benefit of heat removal that can be used as a further basis for process management, such as to control and/or limit the exothermic temperature rise.

Yet further particular aspects of the invention relate to the ability to manipulate the water, or moisture, content within the LPG synthesis catalyst system (e.g., within one or more reactors containing catalyst of this system) as a basis for controlling or improving a performance parameter that has been found to be influenced by this presence of water. Representative performance parameters include (i) the yield, or selectivity, to LPG hydrocarbons, (ii) the stability of the LPG synthesis catalyst system, and (iii) an exotherm or maximum temperature of the LPG synthesis catalyst system. Any of such parameters, or combination of parameters, may, for example, be monitored and used as a basis for adjusting water content, such as by removing varying amounts of water from the process and/or recycling varying amounts of a water-depleted, or dried, process stream. Overall, water removal may be used to improve these parameters relative to a baseline process operating identically in all respects except for a lack of water removal.

Accordingly, representative embodiments of the invention are directed to processes for producing an LPG product comprising propane and/or butane. Such processes may comprise (a) in an LPG synthesis stage, contacting a synthesis gas feed comprising $H_2$ and CO, or possibly comprising $H_2$ and $CO_2$, with an LPG synthesis catalyst system to produce an LPG synthesis effluent comprising the LPG product, and (b) removing a water-enriched product from the LPG synthesis stage, such as between reactors of this stage, from upstream of this stage, and/or from downstream of this stage. According to other embodiments, in processes comprising step (a) as defined above, step (b) may comprise adjusting a content of water in the LPG synthesis stage to improve a performance parameter of the process (e.g., relative to a baseline process), with specific performance parameters including any of those described above. In any of these embodiments, depending on the various process flow configurations that may be employed, the LPG product and LPG synthesis effluent from which this product may ultimately be separated, may be provided in (i) an LPG synthesis reactor effluent or possibly (e.g., in the case of the LPG synthesis stage comprising multiple LPG synthesis reactors, such as two reactors) a downstream LPG synthesis reactor effluent, such as a second reactor effluent, or (ii) a withdrawn portion of an LPG synthesis reactor effluent or possibly (e.g., in the case of the LPG synthesis stage comprising multiple LPG synthesis reactors, such as two reactors) a withdrawn portion of a downstream LPG synthesis reactor effluent, such as a withdrawn portion of second reactor effluent (e.g., in the case of operation with recycling of a recycle portion of the LPG synthesis effluent that is removed from the withdrawn portion). More specifically, the LPG product and LPG synthesis effluent may, in some embodiments, be provided in (i) a cooled LPG synthesis reactor effluent or possibly a cooled downstream LPG synthesis reactor effluent, or (ii) a cooled withdrawn portion of an LPG synthesis reactor effluent or possibly a cooled withdrawn portion of a downstream LPG synthesis reactor effluent. This may apply, for example, if cooling and condensation are used for water removal from an LPG synthesis reactor effluent or a downstream LPG synthesis reactor effluent, any of which associated reactor(s) producing these reactor effluent(s) may utilize recycle, such as in the particular case of operating as a loop reactor.

Representative LPG synthesis catalyst systems have activities for both alcohol (e.g., methanol) and/or ether (e.g., DME) synthesis, as well as dehydration. These catalyst systems may comprise two catalyst types (e.g., in a macroscopically uniform mixture of particles) or otherwise a bi-functional catalyst (e.g., having a macroscopically uniform, particle-to-particle composition) comprising two types of functional constituents. In the case of two catalyst types (e.g., separate compositions, each being in the form of separate particles), these may include both an alcohol (e.g., methanol) synthesis catalyst and a dehydration catalyst, the latter of which may alternatively be referred to as an alcohol to LPG hydrocarbon conversion (ATLPG) catalyst, such as in the case of a methanol to LPG hydrocarbon conversion (MTLPG) catalyst. The separate catalyst types may be present in a given catalyst system (e.g., contained in an LPG synthesis reactor) in the form of a mixture, in the form of individual beds of one type or another (e.g., one or more beds of an alcohol synthesis catalyst alone, and/or one or more beds of a dehydration catalyst alone), or a combination thereof (e.g., one or more beds of a mixture, and/or one or more beds of alcohol synthesis catalyst alone and/or one or more beds of dehydration catalyst alone). In one embodiment, a bed of an alcohol (e.g., methanol) synthesis catalyst may precede (e.g., be positioned upstream of) a bed of a dehydration catalyst. In the case of a bi-functional catalyst, the functional constituents may include both an alcohol (e.g., methanol) synthesis-functional constituent and a dehydration-functional constituent, the latter of which may alternatively be referred to as an alcohol to LPG hydrocarbon conversion- (ATLPG-) functional constituent, such as in the case of a methanol to LPG hydrocarbon conversion- (MTLPG-) functional constituent.

Accordingly, exemplary processes for producing an LPG product comprising propane and/or butane (and preferably both), as described herein, comprise contacting a synthesis gas comprising $H_2$ and CO, or possibly $H_2$ and $CO_2$, with an LPG synthesis catalyst system as described herein, and particularly such catalyst system comprising either separate catalysts or a bi-functional catalyst. In representative processes, the LPG synthesis catalyst systems described herein may be used to provide novel pathways for the production of liquefied petroleum gas (LPG) products comprising propane and/or butane, and in certain cases renewable LPG products, i.e., in which some or all (e.g., at least about 70%) of their carbon content (whether expressed on a wt-% or mole-% basis) is renewable carbon that is not derived from petroleum. Advantageously, whether or not the carbon content is renewable carbon, at least a portion (e.g., at least about 20%, at least about 30%, or at least about 40%) of the total carbon content of representative LPG products described herein may be derived from $CO_2$, for example being present as a component of a methane-containing gaseous feed mixture (e.g., biogas) that is subjected to upstream reforming or otherwise being present as a component of a gasification or pyrolysis effluent. In the case of a non-renewable carbon content that is derived from $CO_2$, such $CO_2$ may be obtained, for example, as a fossil fuel combustion product or a fossil fuel reforming product. In either case, it can be appreciated that $CO_2$ used to provide at least a portion of the total carbon content is beneficially utilized as LPG, rather than being directly released into the atmosphere. Within the environment of an LPG synthesis reactor containing the catalyst system, $CO_2$ may be present in an equilibrium or non-equilibrium amount, together with $H_2$, CO, and $H_2O$ as other reactants/products of reactions leading to LPG hydrocarbons or of other reactions such as the reversible water-gas shift (WGS) reaction.

These and other embodiments, aspects, and advantages relating to the present invention are apparent from the following Detailed Description.

BRIEF DESCRIPTION OF THE DRAWINGS

A more complete understanding of the exemplary embodiments of the present invention and the advantages thereof may be acquired by referring to the following description in consideration of the accompanying figures.

Figure 1:
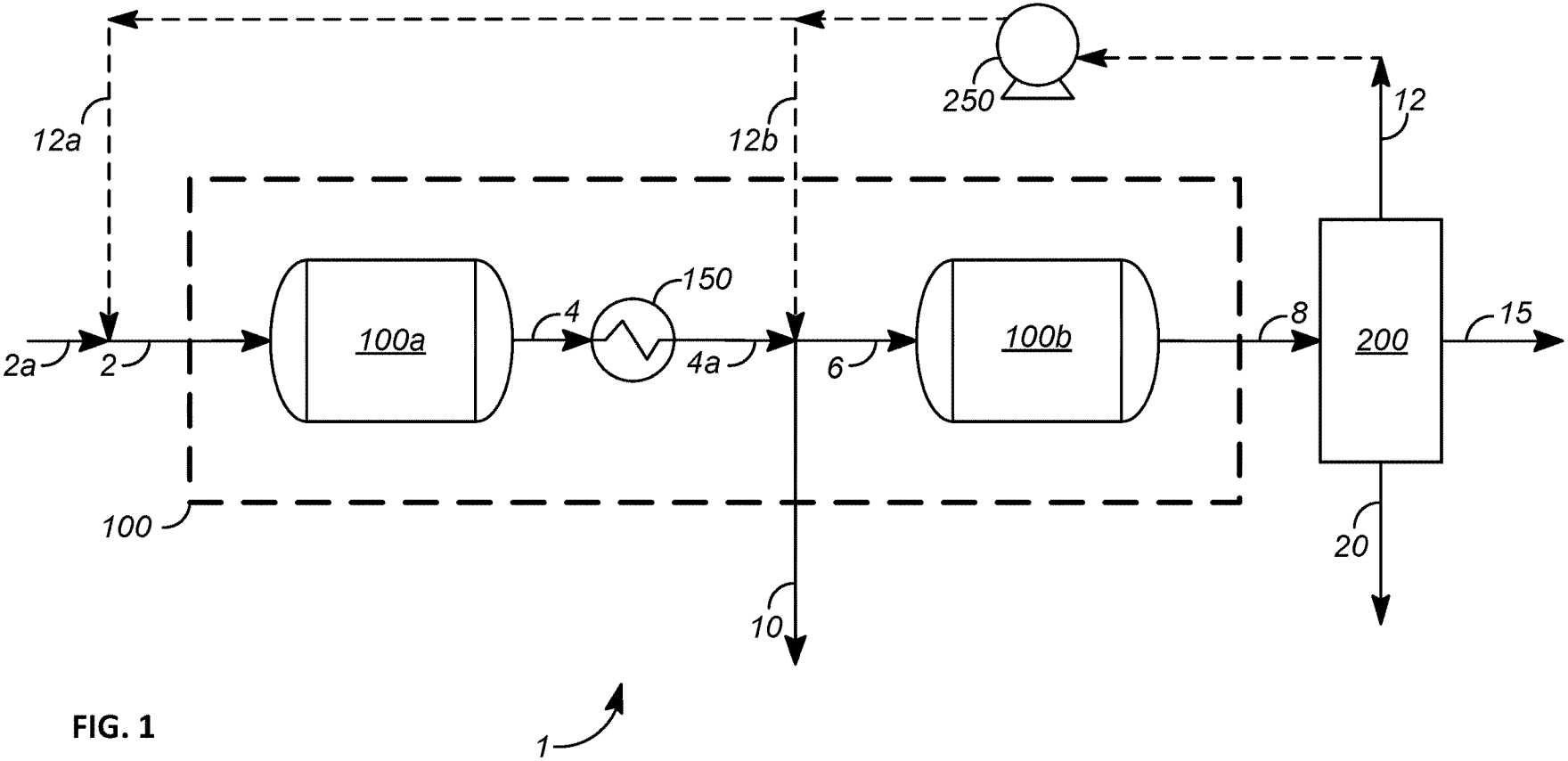
FIG. 1 provides a flow scheme for a process for producing an LPG product, according to which a water-enriched product is removed from an LPG synthesis stage, between a first, upstream LPG synthesis reactor and a second, downstream LPG synthesis reactor.

In the flow schemes provided in FIGS. 1-4, the same reference numbers are used to identify the same or similar features. For the sake of efficiency and ease of understanding, whereas multiple features are illustrated and described in each of these figures, not all features (e.g., not all processing operations and their associated streams and equipment) are necessarily required according to certain processes described and claimed herein and that various specific features illustrated within a figure can be implemented independently of others. Also, various specific features illustrated between or among two or more of the figures can be implemented in combination, according to certain processes described and claimed herein. With respect to various process flows shown in FIGS. 1-4, the use of dashed lines is meant to highlight certain ones that may be considered optional.

In order to facilitate explanation and comprehension, FIGS. 1-4 provide an overview of processes for the production of LPG hydrocarbons. Some associated equipment such as certain vessels, heat exchangers, valves, instrumentation, and utilities, are not shown, as their specific description is not essential to the implementation or appreciation of the various aspects of the invention. Such equipment would be readily apparent to those skilled in the art, having knowledge of the present disclosure. Other processes for producing LPG hydrocarbons, according to other embodiments within the scope of the invention and having configurations and constituents determined, in part, according to particular processing objectives, would likewise be apparent.

Whereas each of FIGS. 1-4 illustrate a water-enriched product 10 that may be removed or withdrawn from the process, this removal or withdrawal is illustrated to emphasize, more generally, possible points at which water, in liquid or vapor form, may be separated from the process, but without necessarily generating a separate process stream. For example adsorption of water from a gas stream to provide a corresponding, water-depleted or dried gas stream, may involve the separated water becoming sequestered within pores of adsorbent, in which case it can be appreciated that no continuous water-enriched stream would be generated, although periodic regeneration of spent adsorbent, having reached its adsorptive capacity, could periodically generate such water-enriched stream.

DETAILED DESCRIPTION

The expressions "wt-%" and "mol-%," are used herein to designate weight percentages and molar percentages, respectively. The expressions "wt-ppm" and "mol-ppm" designate weight and molar parts per million, respectively. For ideal gases, "mol-%" and "mol-ppm" are equal to percentages by volume and parts per million by volume, respectively. In some cases, a percentage, "%," is given with respect to values that are the same, whether expressed as a weight percentage or a molar percentage. For example, the percentage of the carbon content of the LPG product that is renewable carbon, has the same value, whether expressed as a weight percentage or a molar percentage. Quantities expressed as a mole fraction refer to the value in mol-%, divided by 100.

The term "substantially," as used herein, refers to an extent of at least 95%. For example, the phrase "substantially all" may be replaced by "at least 95%." The phrase "substantially the same as" may be replaced by "within +/−5% of." The phrases "all or a portion," and "at least a portion," are meant to encompass, in certain embodiments, "at least 50%," "at least 75%," "at least 90%," or "all" of the total to which they refer. Unless expressly stated otherwise, reference to any starting material, intermediate product, byproduct, or final product, which are all preferably process streams in the case of continuous processes, should be understood to mean "all or a portion" of such starting material, intermediate product, byproduct, or final product, in view of the possibility that some portions may not be used, such as due to sampling, purging, diversion for other purposes, mechanical losses, etc. Therefore, for example, the phrase "separating the LPG product" should be understood to mean separating all or a portion of the LPG product. As in the case of "all or portion" being expressly stated, when "all or a portion" is the understood meaning, this phrase is should further be understood to encompasses certain embodiments as noted above.

Representative processes described herein for the production of LPG hydrocarbons may comprise a number of unit operations, with one of such operations designated as an "upstream" operation that is performed or carried out before, prior to, or upstream of, another of such operations, and/or with one of such operations designated as a "downstream" operation that is performed or carried out after, subsequent to, or downstream of, another of such operations. Terms referring to the order in which one operation is performed or carried out relative to another, are in reference to the overall process flow, as would be appreciated by one skilled in the art having knowledge of the present specification. More specifically, the overall process flow can be defined by the bulk flows of the synthesis gas feed, LPG synthesis effluent obtained from the LPG synthesis stage, and any recycle portions or fractions obtained from the LPG synthesis effluent. In the case of such recycle portions or fractions leading directly or indirectly back to the LPG synthesis stage, operations performed on these recycle portions or fractions may nonetheless be considered operations downstream of the LPG synthesis stage. Therefore, for example, in the case of removing the water-enriched product from a recycle portion of the LPG synthesis effluent or, more specifically, a cooled recycle portion of the LPG synthesis effluent, the operations of (i) removing the water-enriched product, and optionally (ii) cooling the recycle portion of the LPG synthesis effluent prior to this removal, may be considered as operations occurring downstream of the LPG synthesis stage.

Insofar as "upstream," "downstream," "before," "after," "prior to," "subsequent to," may be used to designate order, in specific embodiments these terms mean that one operation immediately precedes or follows another operation, whereas more generally these terms do not preclude the possibility of intervening operations. Therefore, for example, the operations of (i) removing the water-enriched product, and optionally (ii) cooling the first, upstream LPG synthesis reactor effluent, can occur between a first, upstream LPG synthesis reactor and a second, downstream LPG synthesis reactor. More generally, to the extent that representative processes described herein are defined as including certain unit operations, unless otherwise stated or designated (e.g., by using the phrase "consisting of"), such processes do not preclude the use of other operations, whether or not specifically described herein.

With respect to the term "portion," such as in the phrase "recycle portion of the LPG synthesis effluent," in preferred embodiments this term designates a separated material having the same, or substantially the same, composition as that from which it has been separated, although the amounts of the portions obtained from the separation may be different. For example, both the "recycle portion of the LPG synthesis effluent" and a "withdrawn portion of the LPG synthesis effluent" may be obtained from separation of the LPG synthesis effluent, and both the recycle portion and withdrawn portion may have the same or substantially the same composition, being also the same or substantially the same as the LPG synthesis effluent itself. The recycle portion of the LPG synthesis effluent may be returned to the LPG synthesis stage, whereas the withdrawn portion of the LPG synthesis effluent may be provided to a separation stage, downstream of the LPG synthesis stage, for separating the LPG product and other product fractions.

In this regard, with respect to the term "fraction," such as in the phrase "gaseous fraction," in preferred embodiments this term designates a separated material having a composition that differs from that of the material from which it has been separated. Therefore, for example, a "gaseous fraction" separated from the LPG synthesis effluent or a portion thereof will generally be enriched in, or have a greater content (e.g., in mol-%) of, non-condensable gases (e.g., $H_2$, CO, and/or $CO_2$) relative to that of the LPG synthesis effluent. Likewise, a "heavy byproduct fraction" will generally be enriched in, or have a greater content (e.g., in wt-%) of $C_5$ hydrocarbons and/or oxygenated hydrocarbons, such as alcohol and/or ethers, relative to that of the LPG synthesis effluent. The separation of a "fraction," as opposed to a "portion," may involve energy input (e.g., to cause heating/volatilization) and/or the use of equipment (e.g., fractionation columns, membranes, adsorbents, filters, etc.) configured to enrich that fraction in one or more compounds (e.g., LPG hydrocarbons) for effective operation of the process, in terms of separating some (e.g., desired) compounds in a given fraction, from other (e.g., undesired) compounds, in other fractions that may be optionally recycled to the LPG synthesis stage. Representative equipment for these purposes may be used, for example, in a separation stage, downstream of the LPG synthesis stage, to separate the LPG product from all or a portion of the LPG synthesis effluent. In view of this description, the LPG product may be considered an LPG product fraction.

Accordingly, a "water-enriched product" may be considered a water-enriched product fraction, insofar as this product/fraction has a water content that is greater than that of the material (e.g., first reactor effluent, cooled first reactor effluent, loop reactor effluent, cooled loop reactor effluent, recycle portion of the LPG synthesis effluent, cooled recycle portion of the LPG synthesis effluent, or LPG synthesis effluent) from which it is separated. The ability to obtain the water-enriched product may reside in the use of a cooler or condenser to preferentially condense and separate liquid water over other components (e.g., propane and/or butane) in the material (e.g., gas stream) from which it is separated. Alternatively, a water-enriched product may be obtained using an adsorbent or membrane separation system as described herein. Given these possibilities for separating water from, or drying, various process streams, the phrase "removing a water-enriched product" may be interpreted to mean that such water-enriched product is withdrawn continuously from the process as a separate stream, but in other embodiments may be interpreted to mean that such water-enriched product is sequestered (e.g., within pores of adsorbent) from, or within, the process for a period of time, after which the sequestered, water-enriched product may be withdrawn (e.g., by removal of the adsorbent from the process flow, such as in the case of a swing-bed operation, followed by regeneration).

Whether or not the water-enriched product is withdrawn continuously or periodically (e.g., by periodic adsorbent regeneration), such separation results in a corresponding, water-depleted product (e.g., second reactor water-depleted feed, water-depleted LPG synthesis effluent, water-depleted recycle) having a water content that is less than that of the material from which it is separated. According to particular embodiments, the water-enriched product may have a water content of at least about 50 wt-%, at least about 75 wt-%, at least about 90 wt-%, at least about 95 wt-%, or at least about 99 wt-%. The balance of the water-enriched product may be all, or substantially all, of one or more compounds selected from the group consisting of propane, butane, $C_5^+$ hydrocarbons, and oxygenated hydrocarbons, which may include alcohols and/or ethers. The corresponding water-depleted product, optionally in combination any of such water contents of the water-enriched product, may have a water (or steam) content of less than about 25 mol-% (i.e., a mole fraction of less than about 0.25), less than about 10 mol-% (i.e., a mole fraction of less than about 0.10), less than about 5 mol-% (i.e., a mole fraction of less than about 0.05), or less than about 1 mol-% (i.e., a mole fraction of less than about 0.01).

A "synthesis gas feed comprising $H_2$ and CO," or more simply "synthesis gas feed," as described herein, may be representative of a portion of, or the entirety of, the material that is fed or input, e.g., that is input in one feed stream, or in two or more separate or combined feed streams, to an LPG synthesis reactor of an LPG synthesis stage, used to carry out the conversion of at least a portion of the $H_2$ and CO, or at least a portion of the $H_2$ and $CO_2$, to propane and/or butane that is contained in an LPG product. The synthesis gas feed comprising $H_2$ and CO, or comprising $H_2$ and $CO_2$, may be, or may comprise, in particular embodiments, a synthesis gas intermediate, or portion thereof, which is produced in an upstream reaction stage, such as a stage for carrying out reforming to generate $H_2$ and CO. Whether or not obtained from a synthesis gas intermediate, at least a portion of the $H_2$ and CO, optionally in combination with $CO_2$, in the synthesis gas feed may be converted by contact with an LPG synthesis catalyst system as described herein, to propane and/or butane that is contained in the LPG product. The "synthesis gas feed comprising $H_2$ and CO," "synthesis gas feed comprising $H_2$ and $CO_2$," or "synthesis gas feed" may include a combination of both (i) a fresh makeup feed external to the LPG synthesis stage, such as a synthesis gas intermediate, and (ii) a recycled product obtained from the LPG synthesis stage, such as a portion of an LPG synthesis effluent and/or a fraction separated from this effluent (e.g., a gaseous fraction), which is returned to the LPG synthesis stage, or LPG synthesis reactor of this stage.

Any source of synthesis gas comprising $H_2$ and CO, or otherwise comprising $H_2$ and $CO_2$, may be used as a feed to an LPG synthesis reactor, in representative LPG production processes, including a synthesis gas that is produced at least partly by reforming. According to particular embodiments, the synthesis gas feed may comprise $H_2$ and CO in any suitable amounts (concentrations), such as in combined amount of greater than about 25 mol-% (e.g., from about 25 mol-% to 100 mol-%), greater than about 50 mol-% (e.g., from about 50 mol-% to about 99 mol-%), or greater than about 75 mol-% (e.g., from about 75 mol-% to about 99 mol-%). With respect to any such combined amounts (concentrations), the $H_2$:CO molar ratio of the synthesis gas feed may be from about 1.0 to about 7.0, such as from about 4.0 to about 6.5, in the case of relatively high ratios. Otherwise, in the case of relatively low ratios, the $H_2$:CO molar ratio of the synthesis gas feed may be from about 1.0 to about 3.0, such as from about 1.8 to about 2.4. In view of particular, proposed routes to LPG hydrocarbons, as described below, the synthesis gas feed may have an $H_2$:CO molar ratio of at least about 1.0 (e.g., from about 1.0 to about 3.5 or from about 1.5 to about 3.0), or more preferably at least about 2.0 (e.g., from about 2.0 to about 4.0, from about 2.0 to about 3.0, or from about 2.0 to about 2.5). In some cases, excess $H_2$ (i.e., $H_2$ in excess of the stoichiometric amount needed to react with CO and/or $CO_2$ to form a methanol intermediate according to the reactions below, or otherwise a DME intermediate) may be used to improve stability of a given LPG synthesis catalyst system. Desired molar ratios may be obtained, optionally following an adjustment (e.g., increase) occurring upstream of the conversion of the synthesis gas feed (e.g., upstream of the LPG synthesis stage or LPG synthesis reactor used in this stage).

Given that (i) CO can be obtained from $CO_2$ via the equilibrium-limited WGS reaction, and (ii) $CO_2$ can itself react (albeit not as readily as CO) to form LPG hydrocarbons, the synthesis gas feed may alternatively comprise $H_2$ and $CO_2$, and may not necessarily comprise CO. In many cases, however, the synthesis gas feed comprising $H_2$ and $CO_2$ will also comprise CO. In the case of a synthesis gas feed comprising $H_2$ and $CO_2$, whether or not such feed also comprises CO, the $H_2$:$CO_2$ molar ratio of such synthesis gas feed may be within any of the numerical ranges as described above with respect to $H_2$:CO molar ratios, given that $CO_2$, like CO, may also react and provide a source of carbon for LPG hydrocarbons, for example according to specific reactions described below. According to other embodiments, given the stoichiometry of these specific reactions and considering that a greater number of moles of $H_2$ is needed to convert oxygen in each mole of $CO_2$ relative to that needed to convert oxygen in each mole of CO, the $H_2$:$CO_2$ molar ratio of the synthesis gas feed may be greater than the numerical ranges as described above with respect to $H_2$:CO molar ratios. The synthesis gas feed may have an $H_2$:$CO_2$ molar ratio of generally at least about 1.0, such as from about 1.0 to about 5.0 or from about 1.5 to about 4.0, or more preferably at least about 3.0, such as from about 3.0 to about 5.0, from about 3.0 to about 4.0, or from about 3.0 to about 3.5. The synthesis gas feed may also or alternatively be characterized, for example in the case of this feed comprising $H_2$ and both CO and $CO_2$, by an $H_2$:(CO+$CO_2$) molar ratio within any of the numerical ranges described above with respect to $H_2$:CO molar ratios or with respect to $H_2$:$CO_2$ molar ratios. Independently of, or in combination with, the representative amounts (concentrations) of $H_2$ and CO above and/or representative $H_2$:CO molar ratios above, the synthesis gas feed may further comprise $CO_2$, for example in an amount of at least about 5 mol-% (e.g., from about 5 mol-% to about 50 mol-%), at least about 10 mol-% (e.g., from about 10 mol-% to about 35 mol-%), or at least about 15 mol-% (e.g., from about 15 mol-% to about 30 mol-%). In such cases of a synthesis gas feed comprising $CO_2$, the balance of this feed may include $H_2$ and CO in combination, for example in an $H_2$:CO molar ratio as described herein. Representative synthesis gas feeds may therefore comprise $H_2$, together with CO and/or $CO_2$, being present in a combined amount of at least about 50 mol-% (e.g., from about 50 mol-% to about 99 mol-%), at least about 75 mol-% (e.g., from about 75 mol-% to about 97 mol-%), or at least about 85 mol-% (e.g., from about 85 mol-% to about 95 mol-%). In such synthesis gas feeds comprising $H_2$ and CO, these may be present in an $H_2$:CO) molar ratio as described above. In such synthesis gas feeds comprising $H_2$ and $CO_2$, these may be present in range of $H_2$:$CO_2$ molar ratios that correspond numerically to any ranges of $H_2$:CO molar ratios as described above. Other components of a synthesis gas feed may include inert gases such as $N_2$, light hydrocarbons such as $CH_4$ and/or $C_2H_6$, and/or LPG hydrocarbons.

An "LPG synthesis stage" may comprise a single reactor containing, or otherwise may comprise two or more reactors containing in combination, an LPG synthesis catalyst system as described herein that is used to carry out the conversion of the synthesis gas feed to LPG hydrocarbons. For example, in the case of two reactors being used in an LPG synthesis stage, these may include both a first, upstream LPG synthesis reactor, which the synthesis gas feed is input, and a second, downstream LPG synthesis reactor, to which a least a portion of the effluent of the first reactor is fed and from which the LPG synthesis effluent is withdrawn. Different reactors of an LPG synthesis stage may therefore be used to contain respective portions (e.g., a first reactor portion and a second reactor portion) of the LPG synthesis catalyst system, which portions may be the same or different in composition and/or amount. Likewise, the same or different operating conditions, although being generally within "LPG synthesis reaction conditions" as described herein, may be used in different reactors of an LPG synthesis stage. The one or more reactors of an LPG synthesis stage may contain the LPG synthesis catalyst system (i) in the form of a fixed bed, i.e., the LPG synthesis stage may comprise one or more fixed bed reactors; (ii) in the form of a fluidized bed, i.e., the LPG synthesis stage may comprise one or more fluidized bed reactors; or (iii) in the form of another bed type, such as a moving bed. Any of these reactors, characterized by the form of the contained catalyst, may be adiabatic reactors. For example, in representative embodiments, the LPG synthesis stage may comprise one or more fixed bed reactors that are adiabatic reactors, or may comprise one or more fluidized bed reactors that are adiabatic reactors.

The conversion of the synthesis gas feed to the LPG hydrocarbons propane and butane may proceed through a mechanism whereby an alcohol (e.g., methanol) produced from $H_2$ and CO (according to an alcohol synthesis reaction) is dehydrated to the LPG hydrocarbons and water. Alternatively to, or in combination with, alcohol synthesis, the conversion of synthesis gas feed to LPG hydrocarbons may proceed through a mechanism whereby an ether (e.g., DME) is produced. For example, in the case of a combination, methanol or other alcohol produced initially may be dehydrated to DME or other ether, which is then further dehydrated to LPG hydrocarbons. Accordingly, the terms "alcohol synthesis catalyst" and "alcohol synthesis-functional constituent" should be understood to refer to catalysts and functional constituents that may catalyze, or at least lead to (mechanistically), the formation of ethers (e.g., DME), alternatively to, or in combination with, the formation of alcohols (e.g., methanol).

According to particular embodiments, therefore, an LPG product comprising propane ($C_3H_8$) and/or butane ($C_4H_{10}$), may be obtained using catalyst systems as described herein for catalyzing reactions of methanol synthesis and dehydration, as follows:

$$14H_2+7CO \rightarrow 7CH_3OH \text{ (methanol synthesis), and}$$

$$7CH_3OH+2H_2 \rightarrow C_3H_8+C_4H_{10}+7H_2O \text{ (dehydration).}$$

According to the above reactions, the LPG hydrocarbons propane and butane may be produced from a synthesis gas feed through a methanol intermediate. As noted above, LPG hydrocarbons may also be produced from a synthesis gas feed through a DME intermediate, such as in the case of $H_2$ and CO reacting to form DME ($CH_3OCH_3$) and water, followed by dehydration of DME to LPG hydrocarbons. Otherwise, LPG hydrocarbons may be produced from a synthesis gas feed through both a methanol intermediate and a DME intermediate, such as in the case of $H_2$ and CO reacting to form methanol, followed by dehydration of methanol to DME, and further dehydration of DME to LPG hydrocarbons.

Alternatively, or in combination, $CO_2$ present in the synthesis gas feed may likewise advantageously be reacted in an initial methanol synthesis, or in an initial DME synthesis, according to a second pathway. For example, in the case of producing the same number of moles of $CH_3OH$ shown in the first reaction above, $CO_2$, rather than CO, may be consumed according to:

$$21H_2+7CO_2 \rightarrow 7CH_3OH+7H_2O \text{ (methanol synthesis).}$$

More generally, the LPG product comprising propane and/or butane may be produced through synthesis of a methanol intermediate or higher alcohol intermediate, i.e., through an alcohol intermediate generally, which is obtained from the reaction of $H_2$ with CO or $CO_2$, according to the following generalized reactions:

$$2nH_2+nCO \rightarrow C_nH_{2n+1}OH+(n-1)H_2O \text{ and/or}$$

$$(3n+b)H_2+(n+b)CO_2 \rightarrow C_nH_{2n+1}OH+(2n+b-1)H_2O+bCO \text{ (alcohol synthesis), and}$$

$$(7/n)C_nH_{2n+1}OH+2H_2 \rightarrow C_3H_8+C_4H_{10}+(7/n)H_2O \text{ (dehydration).}$$

As noted above, LPG hydrocarbons propane and/or butane may also be produced from a synthesis gas feed more generally through an ether intermediate, such as in the case of $H_2$ and CO reacting to form an ether (e.g., $C_nH_{2n+1}O$ $C_nH_{2n+1}$) and water, followed by dehydration of the ether to LPG hydrocarbons. Otherwise, LPG hydrocarbons may be produced from a synthesis gas feed through both an alcohol intermediate and an ether intermediate, such as in the case of $H_2$ and CO reacting to form an alcohol, followed by dehydration of the alcohol to the ether, and further dehydration of the ether to LPG hydrocarbons. Whereas the above reactions are illustrative of possible pathways for obtaining LPG hydrocarbons from a synthesis gas feed, these are to be construed as exemplary reactions, without limitation of embodiments of the invention, unless expressly included as elements of such embodiments. Those skilled in the art having knowledge of the present disclosure will appreciate that these and other possible pathways, including other reaction stoichiometries, may be used to explain observed results of obtaining LPG hydrocarbons from a synthesis gas feed.

Representative Processes and Conditions

With respect to the conversion of a synthesis gas feed comprising $H_2$ and one of both of CO and/or $CO_2$, an LPG product may be produced according to a process that comprises (a) in an LPG synthesis stage, contacting this synthesis gas feed with an LPG synthesis catalyst system as described herein, to produce an LPG synthesis effluent comprising the LPG product. The process may further comprise (b) removing a water-enriched product from the LPG synthesis stage, or, more particularly, downstream of the LPG synthesis stage. As described above, the step of removing the water-enriched product may include continual withdrawal of this product, for example in stream 10 as illustrated in FIGS. 1-4, or otherwise the isolation or sequestration of this product within the process, such as in a bed of adsorbent having selectivity for water over other components of a process stream that the adsorbent is used to treat, i.e., dry.

In the case of continual withdrawal of a water-enriched product, this may be achieved by cooling, using a suitable cooler, to condense and remove liquid water in the water-enriched product and provide any designated "water-depleted" process streams described herein. Continual withdrawal may likewise be achieved using membrane separation, with a membrane having selective permeability or selective retention of water over other components of a process stream that the membrane is used to treat, i.e., dry, and thereby provide any designated "water-depleted" process streams described herein (e.g., a water-depleted LPG synthesis effluent). In the case of isolation or sequestration of a water-enriched product, removing this product may be performed periodically, such as by adsorbent regeneration to periodically drive off accumulated water after the adsorbent capacity has been reached. Adsorbents selective for water vapor and therefore being suitable for the removal of vapor phase $H_2O$ and consequently the drying of various process streams, include, but are not limited to, 3 A, 4 A, and 5 A molecular sieves. Such adsorbents may thereby provide any designated "water-depleted" process streams described herein (e.g., a water-depleted LPG synthesis effluent). Accordingly, the water-enriched product may be removed by various removal methods, including (i) cooling and condensation, (ii) adsorptive separation, or (iii) membrane separation. Any designated "water-depleted" process stream may also be considered a "dried" process stream, insofar as the process stream obtained from water removal (e.g., a water-depleted LPG synthesis effluent or water-depleted recycle portion of this effluent) contains a reduced amount of water, such as in the form of water vapor, relative to the process stream prior to water removal (e.g., relative to the LPG synthesis effluent). In representative embodiments, a water removal method, such as (i), (ii), and/or (iii) above, may be used to obtain a corresponding water-depleted or dried process stream having a water content of less than about 10 mol-%, less than about 5 mol-%, or less than about 1 mol-%. Alternatively, or in combination, such water removal method may remove at least about 90%, at least about 95%, or at least about 99% of water initially present in the corresponding process stream prior to water removal, to provide the corresponding water-depleted or dried process stream.

The LPG product may be an LPG synthesis effluent, i.e., the effluent from one or more LPG synthesis reactors. For example, the LPG product may be obtained without further processing of the LPG synthesis effluent, or otherwise the LPG product may be separated from the LPG synthesis effluent, for example as a fraction of the LPG synthesis effluent that is enriched in propane and/or butane. In either case, the LPG synthesis effluent may be obtained directly from an LPG synthesis reactor that contains an LPG synthesis catalyst system, or at least one catalyst of such system (e.g., an alcohol synthesis catalyst, such as a methanol synthesis catalyst, or a dehydration catalyst), as described herein. In preferred embodiments, processes described herein may further comprise a step of separating the LPG product, obtained from the LPG synthesis stage, from all or a portion of the LPG synthesis effluent. For example, the LPG product may be separated from the entire LPG synthesis effluent exiting the LPG synthesis stage, or otherwise separated from a withdrawn portion of the LPG synthesis effluent, such as a portion of this effluent that remains, or is obtained, from removing a recycle portion of the LPG synthesis effluent (e.g., in the case of operation with a recycle or "loop" reactor).

In addition to this LPG product, processes may further comprise separating one or more other fractions from all or a portion of the LPG synthesis effluent, such as fractions that are depleted in LPG hydrocarbons, relative to the LPG product. For example, such other fraction(s) may include a gaseous fraction, i.e., a fraction that comprises one or more of CO, $H_2$, $CO_2$, and/or water vapor, with such fraction being enriched in these one or more components, relative to the LPG synthesis effluent, or portion of this effluent from which the LPG product is also separated. Such other fraction(s) may, alternatively or in combination, include a heavy byproduct fraction, i.e., a fraction that comprises $C_5^+$ hydrocarbons and/or oxygenated hydrocarbons such as alcohols and/or ethers (e.g., methanol, ethanol, propanol, dimethyl ether, methyl ethyl ether, diethyl ether, etc.), with such fraction being enriched in one or more of these components, relative to the LPG synthesis effluent, or portion of this effluent from which the LPG product is also separated. Such gaseous fraction and/or heavy byproduct fraction represent fractions that, following their separation from the LPG synthesis effluent, or portion of this effluent from which the LPG product is also separated, may advantageously be recycled in the process, such as according to particular embodiments described and illustrated herein. The gaseous fraction and heavy byproduct fraction may, respectively, represent vapor and liquid fractions separated from the LPG synthesis effluent or portion of this effluent from which the LPG product is also separated, e.g., as respective, lower-boiling (more volatile) and higher-boiling (less volatile) fractions, relative to the LPG product.

Any one of more (i) the LPG product, as a product fraction (ii) a gaseous fraction, (iii) a heavy byproduct fraction, and/or (iv) other fraction, may be separated in a separation stage downstream of the LPG synthesis stage. According to some embodiments, this separation stage may also be used to separate the water-enriched product, as another product fraction. A representative separation stage may utilize equipment, such as one or more flash vessels and/or one or more fractionation columns (e.g., which may include auxiliary upwardly-flowing gases, auxiliary downwardly-flowing liquids, and internal contacting elements, to improve performance) to achieve separations as needed, for example by carrying out one or more theoretical stages of vapor-liquid equilibrium contacting, for resolving the various product fractions with desired separation efficiencies (e.g., purity of one or more components).

According to specific embodiments, the LPG product (e.g., following separation in a separation stage) may comprise propane and butane in a combined amount of at least about 60 mol-% (e.g., from about 60 mol-% to about 100 mol-%), at least about 80 mol-% (e.g., from about 80 mol-% to about 100 mol-%), or at least about 90 mol-% (e.g., from about 90 mol-% to about 99 mol-%). Together with such combined amounts, or alternatively, the LPG product may comprise propane and/or butane independently in individual amounts of at least about 25 mol-% (e.g., from about 25 mol-% to about 85 mol-%), at least about 40 mol-% (e.g., from about 40 mol-% to about 80 mol-%), or at least about 50 mol-% (e.g., from about 50 mol-% to about 75 mol-%). The balance of the LPG product may comprise all, or substantially all, pentane or a combination of ethane and pentane. According to other specific embodiments, at least about 40% (e.g., from about 40% to about 95%), at least about 55% (e.g., from about 55% to about 95%), or at least about 70% (e.g., from about 70% to about 95%) of the carbon content of the synthesis gas feed (e.g., the carbon content of CO and/or $CO_2$ present in this feed), or alternatively the carbon content of the fresh makeup feed, forms propane and/or butane of the LPG product. These percentages are equivalently expressed in terms of wt-% or mol-%.

Figure 2:
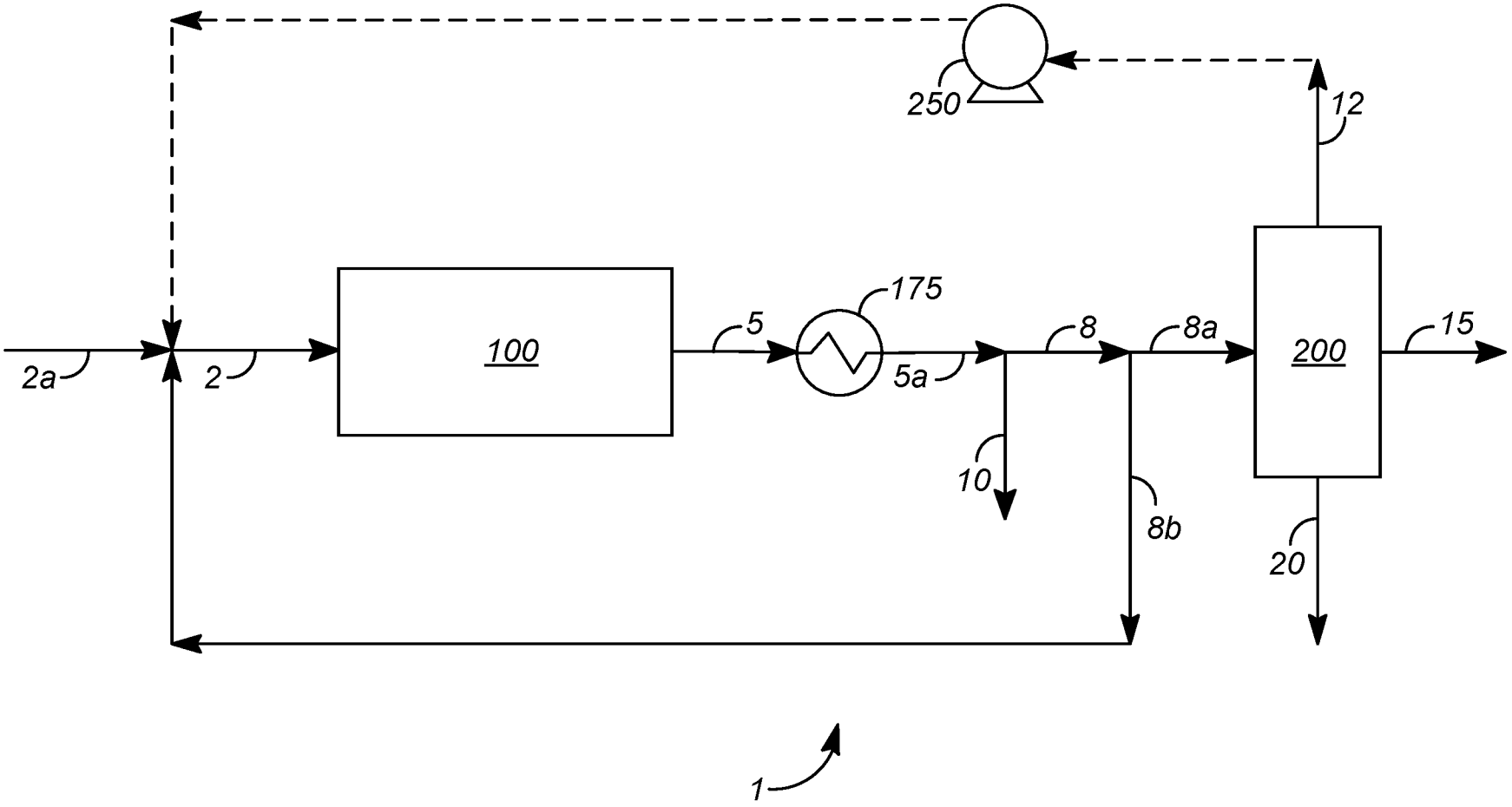
FIG. 2 provides a flow scheme for a process for producing an LPG product, according to which a water-enriched product is removed downstream of the LPG synthesis stage, and more particularly from a loop reactor effluent.
Figure 3:
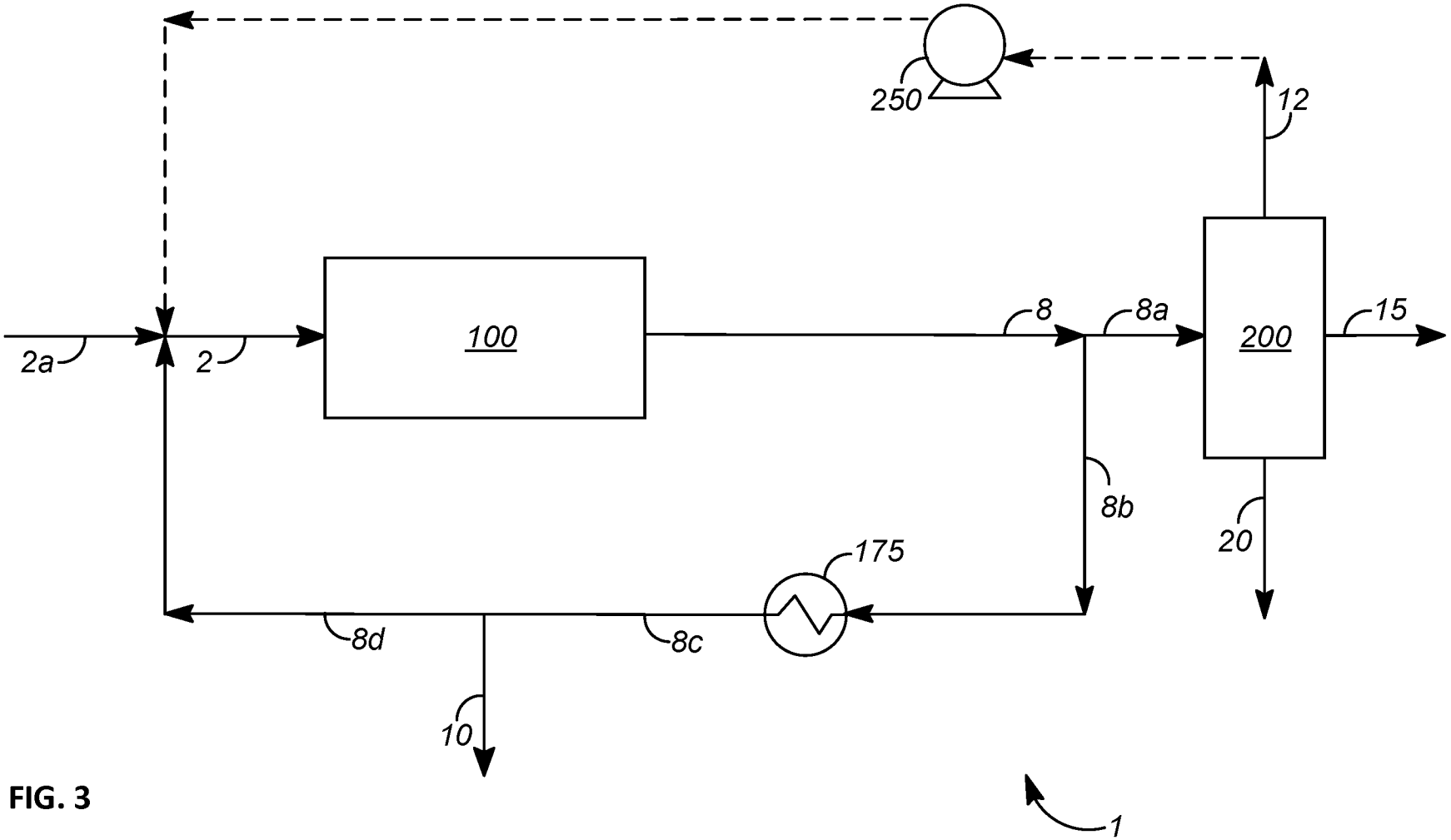
FIG. 3 provides a flow scheme for a process for producing an LPG product, according to which a water-enriched product is removed downstream of the LPG synthesis stage, and more particularly from a recycle portion of the LPG synthesis effluent, which in this illustrated embodiment is also a loop reactor effluent.
Figure 4:
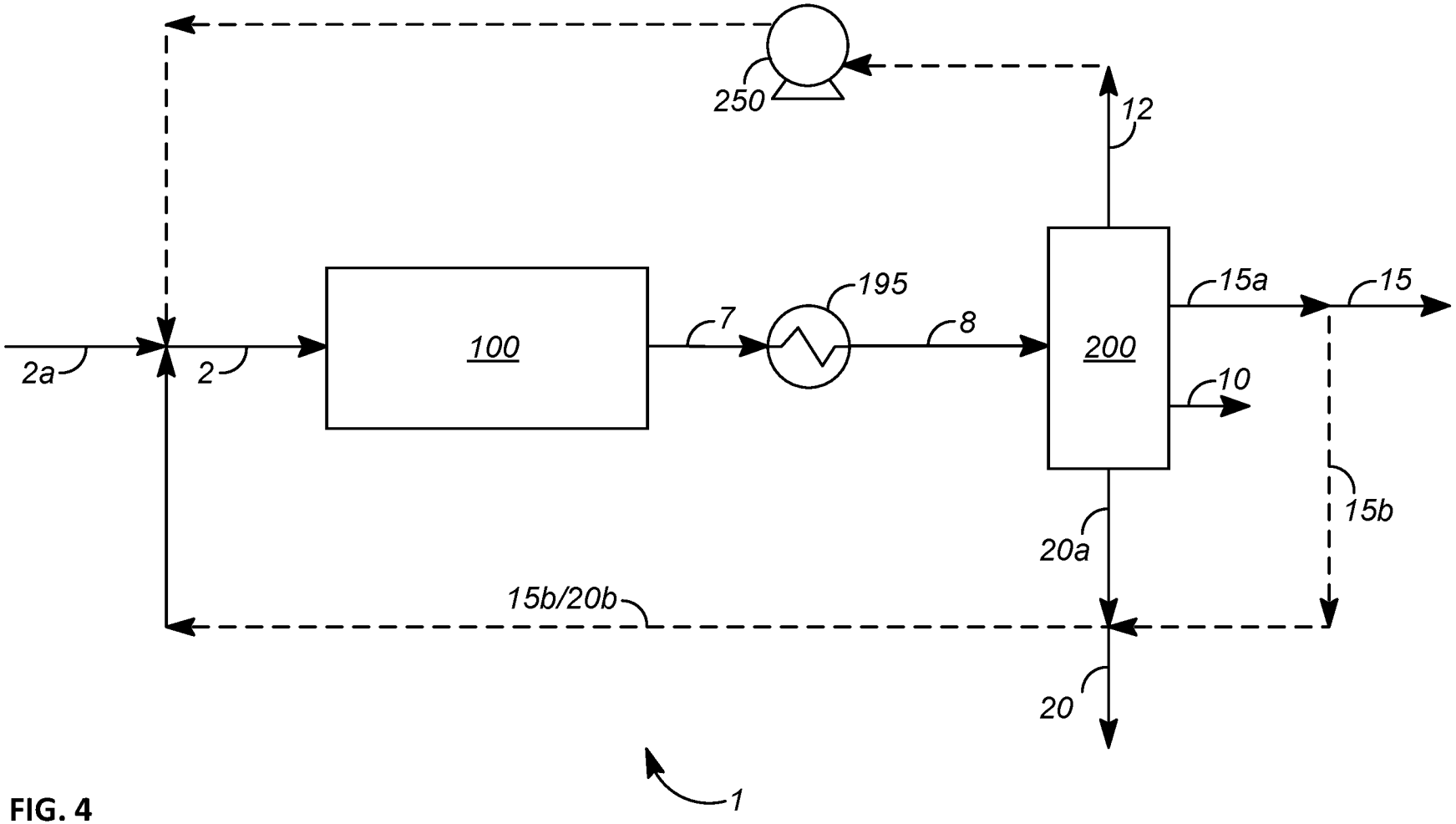
FIG. 4 provides a flow scheme for a process for producing an LPG product, according to which a water-enriched product is removed downstream of the LPG synthesis stage, and more particularly from a separation stage that is used to separate the LPG product, optionally in addition to other fractions.

FIGS. 1-4 illustrate representative processes for producing an LPG product comprising propane and/or butane, with such processes comprising: (a) in LPG synthesis stage 100, contacting synthesis gas feed 2 comprising (i) $H_2$ and CO, and optionally $CO_2$ or (ii) $H_2$ and $CO_2$, and optionally CO, with an LPG synthesis catalyst system as described herein, and contained within one or more LPG synthesis reactors of LPG synthesis stage 100. This contacting produces LPG synthesis effluent 8 that comprises the subsequently-recovered LPG product 15. These processes further comprise removing water-enriched product 10 (e.g., according to any removal methods described above) from LPG synthesis stage 100, such as downstream of this stage. The illustrated processes further comprise separating LPG product 15 from all or a portion of LPG synthesis effluent 8, such as from all or substantially all of this effluent as illustrated in FIGS. 1 and 4, or otherwise from withdrawn portion 8*a* of this effluent as illustrated in FIGS. 2 and 3, providing a loop reactor configuration. As shown in these figures, this withdrawn portion 8*a* is namely that remaining, or obtained, from the removal of recycle portion 8*b* that may be returned to LPG synthesis stage 100, including any reactor of this stage.

According to the particular embodiment illustrated in FIG. 1, LPG synthesis stage 100 may comprise at least first, upstream LPG synthesis reactor 100*a* and second, downstream LPG synthesis reactor 100*b*. In the case of an LPG synthesis stage comprising multiple LPG synthesis reactors, the water-enriched product may be removed between any two of such consecutive reactors. The removal of heat and/or moisture between any two reactors positioned in an upstream-downstream relationship may allow for a staged operation of such reactors, with some degree of operational control between these reactors. For example, two or more fixed bed reactors of an LPG synthesis stage of processes described herein may operate, more particularly, as staged adiabatic reactors, such as in the particular case of upstream LPG synthesis reactor 100*a* and downstream LPG synthesis reactor 100*b* being adiabatic reactors with heat and/or moisture removal between these reactors. Therefore, for example, the step of removing a water-enriched product may comprise removing it from LPG synthesis stage 100, downstream of first reactor 100*a* and upstream of second reactor 100*b*, and namely between these reactors 100*a*, 100*b*. More particularly, as illustrated in FIG. 1, this step may comprise removing water-enriched product 10 from first reactor effluent 4 or, more specifically, from cooled first reactor effluent 4*a* having been cooled in inter-reactor cooler 150 in the case of using cooling and condensation as a removal method. In this embodiment, inter-reactor cooler 150 cools first reactor effluent 4 to provide, in addition to water-enriched effluent 10, second reactor water-depleted feed 6. As also illustrated, representative processes may further comprise, in separation stage 200 downstream of LPG synthesis stage 100, separating LPG product 15 from LPG synthesis effluent 8, which may be an effluent of a downstream reactor of LPG synthesis stage, for example a second reactor effluent. In this case, therefore, all or a portion of the LPG product may be provided in an effluent of a downstream reactor of LPG synthesis stage, for example a second reactor effluent.

In addition to LPG product 15, separation stage may be used to separate, as other product fractions, (i) gaseous fraction 12, comprising unconverted components such as CO, $H_2$, and/or $CO_2$, as well as optionally water vapor, and/or (ii) heavy byproduct fraction 20, comprising $C_5$ hydrocarbons and/or oxygenated hydrocarbons such as alcohols and/or ethers. Although not shown in the embodiment illustrated in FIG. 1, separation stage 200, optionally in combination with separating any of these fractions, may be used to separate water-enriched product 10. Such separation is illustrated, for example, in FIG. 4. In representative processes, therefore, the step of removing a water-enriched product may comprise removing it, as a fraction, from separation stage 200 downstream of LPG synthesis stage 100, with this separation stage also separating LPG product 15, also as a fraction, from the LPG synthesis effluent or any portion thereof, such as a withdrawn portion that is obtained from separating a recycle portion (e.g., a portion that is returned to the LPG synthesis stage or a reactor of this stage).

Separated fractions, such as (i) gaseous fraction 12 and/or (ii) heavy byproduct fraction 20, may be returned to the process, such as by recycle to LPG synthesis stage. For example, as illustrated in FIG. 1, first reactor recycle portion 12*a* and/or second reactor recycle portion 12*b* may be recycled to first reactor 100*a* and/or second reactor 100*b*, respectively, such as by utilizing recycle compressor 250. In some embodiments, all or substantially all of one or more separated fractions, such as (i) and/or (ii), may be recycled to LPG synthesis stage 100 or a reactor 100*a*, 100*b* of this stage. In the case of recycling substantially all of a separated fraction, a purge stream (not shown) may be utilized in order to avoid the accumulation of unwanted components in a given recycle stream. In some embodiments, a portion of the LPG product may also be recycled, optionally in combination with all or a portion of other separated fractions, such as (i) and/or (ii), to LPG synthesis stage 100 or a reactor 100*a*, 100*b* of this stage. For example, FIG. 4 illustrates options for returning recycle portion 15*b* of the LPG product, recycle portion 20*b* of the heavy byproduct, and/or gaseous fraction 12 to LPG synthesis stage 100. In the case of recycle portion 15*b* of the LPG product, the removal of this portion from separated LPG product 15*a*, separated in separation stage 200, may provide LPG product 15 as a net product of the process. Likewise, in the case of recycle portion 20*b* of the heavy byproduct, the removal of this portion from separated heavy byproduct 20*a*, separated in separation stage 200, may provide heavy byproduct 20 as a net product of the process. According to the embodiment illustrated in FIG. 4, LPG synthesis stage effluent 7 (e.g., which may be the effluent obtained from LPG synthesis stage 100 or a reactor of this stage) may, optionally following cooling in LPG synthesis reactor effluent cooler 195, provide LPG synthesis effluent 8, which may also be considered a cooled LPG synthesis effluent. In separation stage 200, fed by LPG synthesis effluent 8, various fractions, including optionally water-enriched product 10, may be separated, and optionally portions of separated fractions may be recycled.

A further processing option utilizing recycle involves returning recycle portion 8*b* of LPG synthesis effluent 8 to LPG synthesis stage, according to a loop reactor configuration, particular embodiments of which are illustrated in FIGS. 2 and 3. As illustrated in FIG. 2, water-enriched product 10 may be removed from the effluent of the LPG synthesis stage, such as by cooling the entire effluent. Alternatively, as illustrated in FIG. 3, water-enriched product 10 may be removed from recycle portion 8*b* of this effluent, such as by cooling only this portion. According to the embodiments illustrated in both FIGS. 2 and 3, the effluent of LPG synthesis stage 100 may be considered a loop reactor effluent. With reference to FIG. 2, the step of removing a water-enriched product may comprise removing it downstream of LPG synthesis stage, such as from loop reactor effluent 5, or, more specifically, from cooled loop reactor effluent 5*a* having been cooled by loop reactor cooler 175 in the case of using cooling and condensation as a removal method. In this embodiment, loop reactor cooler 175 cools loop reactor effluent 5 to provide, in addition to water-enriched effluent 10, LPG synthesis effluent 8, which may also be considered a water-depleted LPG synthesis effluent. A recycle portion 8*b* of the LPG synthesis effluent is returned to LPG synthesis stage 100. With reference to FIG. 3, the step of removing a water-enriched product may comprise removing it downstream of LPG synthesis stage 100, such as from recycle portion 8*b* of the LPG synthesis effluent, or, more specifically, from cooled, recycle portion 8*c* of the LPG synthesis effluent, having been cooled by loop reactor cooler 175 in the case of using cooling and condensation as a removal method. In this embodiment, loop reactor cooler 175 cools recycle portion 8*b* of LPG synthesis effluent 8, which may also be considered a loop reactor effluent, to provide, in addition to water-enriched effluent 10, water-depleted recycle portion 8*d* of the LPG synthesis effluent that is returned to LPG synthesis stage.

Accordingly, all or a portion of LPG product, separated in separation stage 200, may be provided initially in loop reactor effluent 5 and/or cooled loop reactor effluent 5*a*, as well as in LPG synthesis effluent 8 and/or, more specifically, withdrawn portion 8*a* of this effluent, obtained from removing recycle portion 8*b* of this effluent. For example, with reference to the embodiments illustrated in FIGS. 2 and 3, representative processes may comprise, in separation stage 200 downstream of LPG synthesis stage 100, separating LPG product 15 from withdrawn portion 8*b* of the LPG synthesis effluent (being fed or input to the separation stage 200), obtained from the removal of recycle portion 8*a* of this effluent. In the case of utilizing recycle operation, and as apparent from the embodiments illustrated in FIGS. 1-4, synthesis gas feed 2 that is fed to LPG synthesis stage 100 or a reactor of this stage may comprise both fresh makeup feed 2*a* and any recycle stream as described herein (e.g., all or a recycle portion of gaseous fraction 12, a recycle portion of LPG product 15, all or a recycle portion of heavy byproduct 20, and/or a recycle portion of the LPG synthesis effluent). According to further embodiments, representative processes may comprise removing an initial water-enriched product (not shown), for example according to any removal method described herein, from synthesis gas feed 2 or, more specifically, from fresh makeup feed 2*a* that provides at least a portion of the synthesis gas feed. The step of removing an initial water-enriched product may be performed alternatively to, or in combination with, removing water-enriched product 10 according to any of the embodiments described herein.

The LPG synthesis stage, and more particularly one or more LPG synthesis reactors of this stage, are used to contain a catalyst system as described herein, with such catalyst systems having the ability to provide important advantages in terms of activity and stability, leading to process economics favorable for commercialization. A representative LPG synthesis catalyst system may comprise (i) an alcohol synthesis catalyst, such as a methanol synthesis catalyst and (ii) a dehydration catalyst. Alternatively, the LPG synthesis catalyst system may comprise a bi-functional catalyst, having as constituents (i) an alcohol synthesis-functional constituent, such as a methanol synthesis-functional constituent, and (ii) a dehydration-functional constituent.

Conditions in the LPG synthesis stage, and more particularly LPG synthesis reactor(s) used in this stage, are suitable for the conversion of $H_2$ and CO, or $H_2$ and $CO_2$, to propane and/or butane of the LPG product. In representative embodiments, such LPG synthesis reaction conditions, suitable for use in at least one LPG synthesis reactor or, more particularly, one or more catalyst beds contained in such reactor(s), can include an LPG synthesis reaction temperature suitable for providing a given level of performance (e.g., selectivity to and/or yield of LPG hydrocarbons) at least during some operational period of the process. Representative LPG synthesis reaction temperatures may range from about 204° C. (400° F.) to about 454° C. (850° F.), or from about 316° C. (600° F.) to about 399° C. (750° F.). These temperatures may be understood as referring to, in various embodiments, inlet temperature, peak temperature, or weighted average bed temperature (WABT), as described herein.

In the case of inlet temperature of the LPG synthesis catalyst system, this is namely the temperature at which the synthesis gas feed first contacts the LPG synthesis catalyst system, or component of this system (e.g., an alcohol synthesis catalyst in the case of such system comprising two separate catalyst types). The peak temperature is namely the maximum temperature of, or within, the LPG synthesis catalyst system. In the case of the LPG catalyst system being contained in multiple reactors (e.g., an alcohol synthesis catalyst being contained in a first, upstream reactor and a dehydration catalyst being contained in a second, downstream reactor), such peak or maximum temperature may be the highest temperature of all temperatures in the multiple reactors. The WABT, as an alternative measure of temperature according to some embodiments, may be determined, for example, by measuring temperatures within the LPG synthesis catalyst system at multiple points, determining average values between adjacent points, and weighting those average values with weighting factors, totaling 100%, according to the weight percentage of catalyst of the LPG synthesis catalyst system represented by the average values. The weighted average values are then added. For example, the multiple points in the case of an axial flow reactor may be measured along the central axis within a bed of catalyst of the LPG synthesis catalyst system, to approximate WABT in the absence of radial temperature gradients. Notwithstanding the above explanation, the determination of WABT is readily understood by those skilled in the art having knowledge of the present disclosure. In the case of the LPG catalyst system being contained in multiple reactors (e.g., an alcohol synthesis catalyst being contained in a first, upstream reactor and a dehydration catalyst being contained in a second, downstream reactor), the WABT may be determined with respect to the entire amount of catalyst in the multiple reactors.

An LPG synthesis reaction pressure, suitable for use in at least one LPG synthesis reactor, can include a gauge pressure from about 690 kPa (100 psig) to about 6.9 MPa (1000 psig), such as from about 1.38 MPa (200 psig) to about 2.76 MPa (400 psig) or from about 3.4 MPa (500 psig) to about 5.2 MPa (750 psig). The LPG synthesis reaction conditions may include a weight hourly space velocity (WHSV) generally less than about 10 $hr^{-1}$ (e.g., from about 0.01 $hr^{-1}$ to about 10 $hr^{-1}$), typically less than about 5 $hr^{-1}$ (e.g., from about 0.05 $hr^{-1}$ to about 5 $hr^{-1}$), and often less than about 1.5 $hr^{-1}$ (e.g., from about 0.1 $hr^{-1}$ to about 1.5 $hr^{-1}$), as defined above. As is understood in the art, the WHSV is the weight flow of the synthesis gas feed divided by the total weight of catalyst in the LPG synthesis catalyst system (e.g., present in a fixed bed or other reactor bed configuration in the LPG synthesis reactor(s) and represents the equivalent catalyst bed weights of the synthesis gas feed processed per hour. The WHSV may therefore be based on the combined weight of a methanol synthesis catalyst and a dehydration catalyst, or otherwise based on the weight of a bi-functional catalyst, as described herein. The WHSV is related to the inverse of the reactor residence time.

Performance Parameters

Aspects of the invention are associated with the recognition that removing water from processes for producing an LPG product, or adjusting water content generally, may confer important benefits with respect to various performance parameters. Relevant to such aspects, representative processes may comprise (a) in an LPG synthesis stage, contacting a synthesis gas feed comprising $H_2$ and CO (and optionally $CO_2$), or otherwise comprising $H_2$ and $CO_2$ (and optionally CO) with an LPG synthesis catalyst system as described herein to produce an LPG synthesis effluent comprising the LPG product. Particular advantages may be realized in representative processes further comprising (b) adjusting a content of water in the LPG synthesis stage (or a reactor of this stage) to improve a performance parameter of the process. Various options are possible with respect to adjusting a content of water according to step (b). For example, an amount of water removed from a process stream, such as according to any removal method described herein, may be adjusted to provide a water-depleted or dried process stream, all or a portion of which may be recycled to the LPG synthesis stage (or a reactor of this stage). According to particular embodiments, such as those illustrated in FIGS. 1-4, a water-depleted or dried process stream may be a second reactor water-depleted feed (FIG. 1, water removal between reactors of an LPG synthesis stage), a water-depleted LPG synthesis effluent (FIG. 2, water removal from a loop reactor effluent or cooled loop reactor effluent), a water-depleted recycle portion of the LPG synthesis effluent (FIG. 3, water removal from this recycle portion or cooled recycle portion), a water-depleted, separated fraction, which may be a gaseous fraction, a heavy byproduct fraction, and/or the LPG product (FIG. 4, water removal from the separation stage used to separate these fractions).

Alternatively to, or in combination with, adjusting an amount of water removed from a process stream, the amount (e.g., flow) of the resulting water-depleted or dried process stream being recycled to the LPG synthesis stage may be adjusted, in order to adjust the content of water in the LPG synthesis stage. For example, adjusting the content of water according to step (b) above may be performed by adjusting the flow, to the LPG synthesis stage, of any recycle portion of the LPG synthesis effluent, having been subjected to water removal, such as a water-depleted recycle portion of the LPG synthesis effluent. Such water-depleted recycle portion may be obtained, for example, as a portion the LPG synthesis effluent 8 (or water-depleted LPG synthesis effluent) having been subjected to water removal as illustrated in FIG. 2, or may be obtained following water removal from only the recycle portion 8*b* of the LPG synthesis effluent as illustrated in FIG. 3. Adjusting the content of water may likewise be performed by adjusting the flow, to the LPG synthesis stage, of a recycle portion of a separated fraction, which is separated in a separation stage that also removes water, as illustrated in FIG. 4. Adjusting the flow(s) of one or more water-depleted process streams in this manner may also be considered as adjusting the recycle ratio of such stream(s), for example expressed as the volumetric or mass flow ratio of the water-depleted or dried stream being recycled to that of the fresh makeup feed being introduced to the LPG synthesis stage (or a reactor of this stage). Representative recycle ratios may be within a range from about 0.1:1 to about 10:1, such as from about 0.5:1 to about 10:1 or from about 1:1 to about 5:1.

Particular performance parameters that may be improved by adjusting water content, such as by adjusting an amount of water removed from a process stream and/or adjusting the amount (e.g., flow) of the resulting water-depleted or dried process stream being recycled to the LPG synthesis stage, include (i) yield of, or selectivity to, LPG hydrocarbons (also referred to as LPG hydrocarbon yield or LPG hydrocarbon selectivity), (ii) stability of the LPG synthesis catalyst system (also referred to as LPG synthesis catalyst system stability), and (iii) temperature rise (also referred to as exotherm, which may be expressed as the difference between the maximum and minimum temperatures of the LPG synthesis catalyst system, or within a reactor of the LPG synthesis stage) or maximum temperature of the LPG synthesis catalyst system (or within a reactor of the LPG synthesis stage). An improvement, for example obtained by decreasing the water content of the LPG synthesis catalyst system, may be characterized by an increase in (i), an increase in (ii), and/or a decrease in (iii).

Although not a requirement for adjusting its water content, the water content of the LPG catalyst system may be measured or determined, if desired, by analysis (e.g., following sampling) of the environment within the LPG synthesis stage, such as the environment within an LPG synthesis reactor itself, or by analysis of a process stream between one or more LPG synthesis reactors. The water content of the LPG catalyst system may alternatively be determined (e.g., by proxy) by analysis (e.g., following sampling) of the environment external to the LPG synthesis stage, such as by analysis of the synthesis gas feed, loop reactor effluent, LPG synthesis effluent, LPG synthesis stage effluent, etc., as described herein. That is, the water content of the LPG catalyst system, which may be considered the water content of the process, may be measured or determined, according to some embodiments, in the LPG synthesis stage (e.g., in an LPG synthesis reactor or between reactors), or upstream or downstream of this stage. The water content may be expressed according to any suitable characterization based on, or calculated from, analysis of a reactor environment or process stream, such as in terms of mol-% or vol-%, $H_2O$ vapor pressure or partial pressure, relative humidity or saturation level, etc.

In the case of measuring or determining a water content of the process, adjusting the content of water according to step (b) above may be in response to the measured content of water. In this case, if it is desired to reduce the content of water, for example in response to a positive deviation of the measured content of water being above a desired or setpoint water content, an amount of water removed from a process stream, as described herein, may be increased, and/or an amount (e.g., flow) of the resulting water-depleted or dried process stream being recycled to the LPG synthesis stage may be increased, such as by increasing the recycle ratio, as described herein. Conversely, if it is desired to increase the content of water, for example in response to a negative deviation of the measured content of water being below a desired or setpoint water content, an amount of water removed from a process stream, as described herein, may be decreased, and/or an amount (e.g., flow) of the resulting water-depleted or dried process stream being recycled to the LPG synthesis stage may be decreased, such as by decreasing the recycle ratio, as described herein.

In view of the potential benefits, in terms of improving one or more performance parameters of the process, such as those described above, the water content of the process (e.g., in the LPG synthesis stage or external to this stage) may be adjusted in response to a measurement of such performance parameter directly, as opposed to a measurement of the water content. Therefore, for example, in response to a negative or positive deviation of a measured (i) yield of, or selectivity to, LPG hydrocarbons (e.g., a deviation below or above a desired or setpoint yield or selectivity), an amount of water removed from a process stream, as described herein, may be increased or decreased, respectively and/or an amount (e.g., flow) of the resulting water-depleted or dried process stream being recycled to the LPG synthesis stage may be increased or decreased, respectively, such as by increasing or decreasing the recycle ratio, as described herein. In response to a negative or positive deviation of a measured (ii) stability of the LPG synthesis catalyst system (e.g., a deviation below or above a desired or setpoint stability), an amount of water removed from a process stream, as described herein, may be increased or decreased, respectively and/or an amount (e.g., flow) of the resulting water-depleted or dried process stream being recycled to the LPG synthesis stage may be increased or decreased, respectively, such as by increasing or decreasing the recycle ratio, as described herein. In response to a negative or positive deviation of a measured (iii) temperature rise or maximum temperature of the LPG synthesis catalyst system (e.g., a deviation below or above a desired or setpoint temperature rise or maximum temperature) an amount of water removed from a process stream, as described herein, may be decreased or increased, respectively and/or an amount (e.g., flow) of the resulting water-depleted or dried process stream being recycled to the LPG synthesis stage may be decreased or increased, respectively, such as by decreasing or increasing the recycle ratio, as described herein.

With respect to adjusting the water content of the process to improve the temperature rise or maximum temperature of the LPG synthesis catalyst system, such improvement is based on water removal leading to overall heat removal. In this regard, to the extent that the temperature rise (e.g., corresponding to the adiabatic temperature rise or exotherm) of the LPG catalyst system that is otherwise attained in the absence of water removal, may be controlled or reduced, this gives rise to reactor flexibility in terms of reactor types that may be employed. For example, water removal may facilitate the use of either a fluidized bed reactor or a fixed bed reactor (e.g., an adiabatic fixed bed reactor), such that the LPG synthesis stage may comprise such reactor types, containing all or at least a portion of the LPG synthesis catalyst system.

Advantageously, according to representative processes, water removal, such as by removing a water-enriched product, may confer unexpected performance advantages, which may be characterized or quantified in terms improving performance parameters, including those described herein. These advantages may be obtained or validated relative to a baseline or reference process operating identically in all respects, but without water removal (e.g., by removing a water-enriched product), such as according to any removal method described herein. A baseline or reference (comparative) process may utilize the same conditions in terms of temperature, pressure, WHSV, LPG synthesis catalyst system, and reactor and flow configurations, but lack a step of removing a water-enriched product. A given performance parameter may be measured, for comparative purposes, in a process described herein and in a baseline or reference process, at the same time on stream (e.g., same number of hours on stream), or with the LPG synthesis catalyst system having processed the same amount of synthesis gas feed per amount of catalyst (e.g., same number of kilograms feed/gram catalyst), thereby providing a comparison at the same "catalyst life." For example, the performance parameter may be determined as an initial value (i.e., at 0 hours on stream or 0 kilograms feed/gram catalyst). According to particular embodiments, therefore, relative to a baseline or reference process, processes described herein that include removing a water-enriched product may have (i) an increased LPG hydrocarbon yield or LPG hydrocarbon selectivity, (ii) an increased LPG synthesis catalyst system stability, and/or (iii) a decreased exotherm or maximum temperature of the LPG synthesis catalyst system.

A performance parameter of particular significance is conversion, or LPG synthesis conversion level, which may be used to characterize processes described herein. Generally, LPG synthesis catalyst systems and LPG synthesis reaction conditions described herein are suitable for achieving a conversion of $H_2$, CO, and/or $CO_2$ ($H_2$ conversion, CO conversion, and/or $CO_2$ conversion) of at least about 20% (e.g., from about 20% to about 99% or from about 20% to about 95%), at least about 30% (e.g., from about 30% to about 99% or from about 30% to about 95%), or at least about 50% (e.g., from about 50% to about 95% or from about 75% to about 95%). As is understood in the art, the conversion of $H_2$, CO, and/or $CO_2$ in a synthesis gas can be calculated on the basis of:

$$100*(H_{2feed}-H_{2prod})/H_{2feed},\ 100*(CO_{feed}-CO_{prod})/CO_{feed},\ \text{and/or}\ 100*(CO_{2feed}-CO_{2prod})/CO_{2feed}$$

wherein $H_{2feed}$, $CO_{feed}$, and/or $CO_{2feed}$ is the total amount (e.g., total weight or total moles) of $H_2$, CO, and/or or $CO_2$, respectively, in the fresh makeup feed added to the process or in the synthesis gas feed provided to one or more LPG synthesis reactors containing an LPG synthesis catalyst system as described herein, and $H_{2prod}$, $CO_{prod}$, and/or $CO_{2prod}$ is the total amount of $H_2$, CO, and/or $CO_2$ respectively, in the products removed from the process, in the withdrawn portion of the LPG synthesis effluent, or in the effluent from the reactor(s) (which may, but does not necessarily, correspond to the total amount of $H_2$, CO, and/or $CO_2$ in the LPG synthesis effluent). In the case of continuous processes, these total amounts may be more conveniently expressed in terms of flow rates, or total amounts per unit time (e.g., total weight/hr or total moles/hr). These $H_2$, CO, and/or $CO_2$ conversion levels may be based on "per-pass" conversion, achieved in a single pass through one or more LPG synthesis reactors (e.g., determined from amounts in the synthesis gas feed and effluent from the reactor(s)), or otherwise based on overall conversion (e.g., determined from amounts in the fresh makeup feed and in products removed from the process, or in the withdrawn portion of the LPG synthesis effluent), achieved by returning a recycle portion or fraction (e.g., the gaseous fraction) of the LPG synthesis effluent, containing unconverted $H_2$, CO, and/or $CO_2$ (and possibly enriched in these unconverted reactants, relative to the LPG synthesis effluent and/or the LPG product), back to the LPG synthesis stage or reactor(s) of this stage. Whether these LPG synthesis conversion levels are based on $H_2$ conversion, CO conversion, and/or $CO_2$ conversion may depend on which reactant(s) is/are stoichiometrically limited in the synthesis gas feed to the LPG synthesis reactor(s), considering the LPG synthesis reaction chemistry. Preferably, these LPG synthesis conversion levels are based on (i) CO conversion, or conversion of CO in the synthesis gas feed, or otherwise based on (ii) CO and $CO_2$ conversion in combination, or conversion of CO and $CO_2$ in combination, in the synthesis gas feed.

Another performance parameter that may be used to characterize processes described herein for producing an LPG product is selectivity to LPG hydrocarbons (or LPG hydrocarbon selectivity), which may also be considered a carbon selectivity, and this performance parameter refers to the percentage of carbon that is fed or introduced to the LPG synthesis reactor(s) and that manifests in LPG hydrocarbons, namely propane and/or butane (including both of the butane isomers, iso- and normal-butane) in the effluent from the reactor(s), which may, but does not necessarily, correspond to this percentage that manifests in LPG hydrocarbons in the LPG product. For purposes of determining the selectivity to LPG hydrocarbons, the carbon that is fed or introduced to the LPG synthesis reactor(s) may be considered the carbon present in all carbon-containing components (e.g., including hydrocarbons), the carbon present in the CO and $CO_2$ combined, the carbon present in the CO, or the carbon present in the $CO_2$. In preferred embodiments, the selectivity to LPG hydrocarbon is determined based on the carbon present in CO and $CO_2$ combined, which is fed or introduced to the LPG synthesis reactor(s) (e.g., present in CO and $CO_2$ combined, in the synthesis gas feed). In representative embodiments, selectivity to LPG hydrocarbons is at least about 20% (e.g., from about 20% to about 90% or from about 20% to about 75%), at least about 30% (e.g., from about 30% to about 90% or from about 30% to about 75%), at least about 40% (e.g., from about 40% to about 90% or from about 40% to about 75%), or even at least about 50% (e.g., from about 50% to about 90% or from about 50% to about 75%). The selectivity to propane may be at least about 10% (e.g., from about 10% to about 60% or from about 10% to about 50%), at least about 15% (e.g., from about 15% to about 60% or from about 15% to about 50%), or at least about 20% (e.g., from about 20% to about 60% or from about 20% to about 50%). The selectivity to butane (both iso- and normal-butane) may be at least about 5% (e.g., from about 5% to about 45% or from about 5% to about 35%), at least about 10% (e.g., from about 10% to about 45% or from about 10% to about 35%), or at least about 15% (e.g., from about 15% to about 45% or from about 15% to about 35%).

A further performance parameter that may be used to characterize processes described herein for producing an LPG product is the yield of LPG hydrocarbons (or LPG hydrocarbon yield), which may be determined as a per-pass LPG hydrocarbon yield or an overall LPG hydrocarbon yield. A per-pass (or single pass) yield of LPG hydrocarbons refers to the product of (i) the per-pass conversion, which may, according to exemplary embodiments, be more particularly expressed as the per-pass conversion of CO and $CO_2$ in combination, determined as described above, and (ii) the selectivity to LPG hydrocarbons, which may, according to exemplary embodiments, be based on the carbon present in CO and $CO_2$ combined, determined as described above. In an analogous manner, an overall yield of LPG hydrocarbons refers to the product of (i) the overall conversion, which may, according to exemplary embodiments, be more particularly expressed as the overall conversion of CO and $CO_2$ in combination, determined as described above, and (ii) the selectivity to LPG hydrocarbons, which may, according to exemplary embodiments, be based on the carbon present in CO and $CO_2$ combined, determined as described above. In representative processes, the per-pass yield of LPG hydrocarbons or overall yield of LPG hydrocarbons (or per-pass LPG hydrocarbon yield or overall LPG hydrocarbon yield) is at least about 15% (e.g., from about 15% to about 85% or from about 15% to about 70%), at least about 25% (e.g., from about 25% to about 85% or from about 25% to about 70%), at least about 35% (e.g., from about 35% to about 85% or from about 35% to about 70%), or even at least about 45% (e.g., from about 45% to about 85% or from about 45% to about 70%). In some preferred embodiments, the per-pass yield of LPG hydrocarbons in the LPG synthesis stage is at least about 50%.

The $H_2$ conversion, CO conversion, and/or $CO_2$ conversion, in the LPG synthesis reactor(s), as well as other desired performance parameters, may be influenced by adjusting the LPG synthesis reaction conditions described above (e.g., LPG synthesis reaction temperature, LPG synthesis reaction pressure, and/or WHSV). For example, the conversion level (e.g., $H_2$ conversion, CO conversion, and/or $CO_2$ conversion) may be increased by any one of more of increasing temperature, increasing pressure, and decreasing WHSV, having the effects, respectively, of increasing reaction rate, increasing reactant concentrations, and reactor residence times. Those skilled in the art having knowledge of the present disclosure would further appreciate, particularly in view of proposed routes to LPG hydrocarbons as described above, that the conversion level may be increased by adjusting any one or more of the $H_2$:CO molar ratio, $H_2$:$CO_2$ molar ratio, and/or $H_2$:(CO+$CO_2$) molar ratio of the synthesis gas feed, for example by adjusting such ratio(s) to align with a given reaction stoichiometry.

Yet a further performance parameter that may be used to characterize processes described herein for producing an LPG product is the stability of the LPG catalyst system (or LPG synthesis catalyst system stability), with an increase in stability corresponding to a reduced deactivation rate of the LPG synthesis catalyst system and a decrease in stability corresponding to an increased deactivation rate of the LPG synthesis catalyst system. An increased stability/decreased deactivation rate generally results in lower costs associated with, among other beneficial effects, less frequent catalyst replacement. The stability or deactivation rate may be quantified, for example, according to the rate of increase in the LPG synthesis catalyst system temperature (e.g., inlet temperature, peak temperature, or WABT as described herein) needed to maintain a given performance parameter (e.g., CO and/or $CO_2$ conversion, LPG hydrocarbon selectivity, and/or LPG hydrocarbon yield), or otherwise according to the rate of loss in any such performance parameter, at a given LPG synthesis catalyst system temperature.

LPG Synthesis Catalyst Systems

An LPG synthesis catalyst system may comprise two or more different catalyst types, or a single catalyst having two or more different types of functional constituents. The different catalyst types or single catalyst may be contained in one or more LPG synthesis reactors (e.g., in a series or parallel arrangement), at least one of which is fed a synthesis gas feed comprising $H_2$ and CO, or comprising $H_2$ and $CO_2$, for contacting with the LPG synthesis catalyst system, or at least one catalyst type of the system. Preferably, the different catalyst types or single catalyst are contained within a single LPG synthesis reactor, but it is also possible, for example, for separate LPG synthesis reactors to contain each of the different catalyst types. It is also possible for separate LPG synthesis reactors to contain the different catalyst types at different weight ratios and/or in different bed configurations. In one embodiment, a first (upstream) LPG synthesis reactor (e.g., a methanol synthesis reactor) may contain an alcohol synthesis catalyst (e.g., methanol synthesis catalyst) as described herein, and a second (downstream) LPG synthesis reactor (e.g., a dehydration reactor) may contain a dehydration catalyst as described herein. The use of separate reactors allows for reaction conditions to be more precisely aligned with different stages of reactions used to carry out the synthesis of LPG hydrocarbons from a synthesis gas feed. In general, different catalyst types or a single catalyst may be utilized in any particular bed configuration (e.g., fixed bed or fluidized bed), or, in the case of different catalyst types in a fixed bed configuration, in any particular arrangement of individual beds of one catalyst type or another, such as in the case of using one or more beds an alcohol synthesis catalyst (e.g., methanol synthesis catalyst) alone, one or more beds of a dehydration catalyst alone, one or more beds of a mixture of catalyst types at a selected mixing ratio or differing mixing ratios, and/or combinations of such beds. Regardless of the particular bed configuration or particular arrangement of individual beds, preferably the catalyst types or single catalyst is/are in the form of discreet particles, as opposed to a monolithic form of catalyst. For example, such discreet particles of an alcohol synthesis catalyst (e.g., methanol synthesis catalyst), a dehydration catalyst, or a bi-functional catalyst may have a spherical or cylindrical diameter of less than about 10 mm and often less than about 5 mm (e.g., about 2 mm). In the case of cylindrical catalyst particles (e.g., formed by extrusion), these may have a comparable length dimension (e.g., from about 1 mm to about 10 mm, such as about 5 mm).

LPG synthesis catalyst systems may, more particularly, comprise at least two components having different catalytic activities, with such components either being (a) separate compositions (e.g., each composition being in the form of separate particles) of an alcohol synthesis catalyst (e.g., a methanol synthesis catalyst) and a dehydration catalyst, or (b) functional constituents of a bi-functional catalyst (e.g., the catalyst being in the form of separate particles) that is a single composition having both an alcohol synthesis-functional constituent (e.g., a methanol synthesis-functional constituent) and a dehydration-functional constituent. As noted above, a dehydration catalyst may alternatively be referred to as an alcohol to LPG hydrocarbon conversion (ATLPG) catalyst, such as a methanol to LPG hydrocarbon conversion (MTLPG) catalyst, and a dehydration-functional constituent may alternatively be referred to as an alcohol to LPG hydrocarbon conversion- (ATLPG-) functional constituent, such as a methanol to LPG hydrocarbon conversion- (MTLPG-) functional constituent.

The separate catalyst compositions, or otherwise the functional constituents of a bi-functional catalyst, may be present in equal or substantially equal weight ratios. For example, the (i) alcohol synthesis catalyst (e.g., methanol synthesis catalyst) and (ii) dehydration catalyst may be present in the catalyst mixture in a weight ratio of (i):(ii) of about 1:1. Otherwise, the (i) alcohol synthesis-functional constituent (e.g., methanol synthesis-functional constituent) and (ii) dehydration-functional constituent may be present in the bi-functional catalyst in a weight ratio of (i):(ii) of about 1:1. Generally, however, these weight ratios may vary, for example the weight ratios of (i):(ii) in each case may be from about 10:1 to about 1:10, such as from about 5:1 to about 1:5, or from about 3:1 to about 1:3.

In addition to such separate compositions of catalysts or single composition of a bi-functional catalyst, representative LPG synthesis catalyst systems may further comprise additional components, e.g., particles of silicon carbide, silicon nitride, silica or sand, acting to absorb heat and/or alter the distribution of solids. Such additional components may be present in an amount, for example, of at least about 10 wt-% (e.g., from about 10 wt-% to about 80 wt-%), at least about 20 wt-% (e.g., from about 20 wt-% to about 70 wt-%), or at least about 40 wt-% (e.g., from about 40 wt-% to about 60 wt-%), of a given catalyst system. Such additional components may therefore substantially lack catalytic activity and serve non-catalytic purposes. Alternatively, or in combination, additional components may include additional compositions having catalytic activity and/or additional functional constituents having catalytic activity. For example, representative LPG synthesis catalyst systems may comprise additional compositions as described above, such as an additional composition comprising a stabilizer, which may be a noble metal stabilizer such as platinum or a non-noble metal stabilizer such as yttrium (e.g., in elemental form, in the form of an oxide such as yttria or other form) and/or an additional composition comprising one or more promoters selected from the group consisting of Mn, Mg, and Si (e.g., independently in elemental forms, oxide forms, or other forms). In this regard, it can be appreciated that a catalyst system comprising an alcohol synthesis catalyst such as a methanol synthesis catalyst and a dehydration catalyst is not meant to preclude the presence of other catalysts. Likewise, the term "bi-functional catalyst" is not meant to preclude the presence of additional functional constituents. In some embodiments, however, an LPG synthesis catalyst system may consist of, or consist essentially of, two different catalyst types, or otherwise a single catalyst of such catalyst system may consist of, or consist essentially of, two different types of functional constituents. An LPG synthesis catalyst system may also consist of, or consist essentially of, a single type of bi-functional catalyst.

A representative alcohol synthesis catalyst (e.g., methanol synthesis catalyst) or alcohol synthesis-functional constituent (e.g., methanol synthesis-functional constituent) of a bi-functional catalyst may comprise one or more alcohol synthesis-active metals (e.g., methanol synthesis-active metals), with representative metals being selected from the group consisting of copper (Cu), zinc (Zn), aluminum (Al), platinum (Pt), palladium (Pd), and chromium (Cr). In the case of such alcohol (e.g., methanol) synthesis-active metals being Pt and/or Pd, these may, in addition to being considered alcohol (e.g., methanol) synthesis-active metals, also be considered noble metal stabilizers. Any alcohol synthesis-active metals may be in their elemental forms or compound forms. For example, in the case of Cu, Pt, and Pd, these metals are preferably in their elemental forms and, in the case of Zn, Al, and Cr, these metals are preferably in their oxide forms, namely ZnO, $Al_2O_3$, and $Cr_2O_3$, respectively. In some preferred embodiments, all or a portion of Cu, in case of an alcohol synthesis catalyst (e.g., a methanol synthesis catalyst) or alcohol synthesis-functional constituent (e.g., methanol synthesis-functional constituent) comprising this metal, may be in its oxide form CuO. A particular representative alcohol synthesis catalyst, which may more particularly be a methanol synthesis catalyst, is a copper and zinc oxide on alumina catalyst, comprising or consisting essentially of $Cu/ZnO/Al_2O_3$. Such "CZA" alcohol synthesis catalyst (e.g., methanol synthesis catalyst) may also be an alcohol synthesis-functional constituent (e.g., methanol synthesis-functional constituent) of a bi-functional catalyst.

In the case of an alcohol synthesis catalyst (e.g., methanol synthesis catalyst) or alcohol synthesis-functional constituent (e.g., methanol synthesis-functional constituent) of a bi-functional catalyst, the alcohol synthesis-active metals (e.g., methanol synthesis-active metals) Cu, Zn, Pt, Pd, and/or Cr, particularly when in their elemental forms, may be supported on a solid support. Representative solid supports comprise one or more metal oxides, for example those selected from the group consisting of aluminum oxide, silicon oxide, titanium oxide, zirconium oxide, magnesium oxide, calcium oxide, iron oxide, vanadium oxide, chromium oxide, nickel oxide, tungsten oxide, and strontium oxide. The phrase "on a solid support" is intended to encompass alcohol synthesis catalyst solid supports (e.g., methanol synthesis catalyst solid supports) and bi-functional catalyst solid supports in which the alcohol synthesis-active metal(s) (e.g., methanol synthesis-active metal(s)) is/are on the support surface and/or within a porous internal structure of the support. Specific examples of alcohol synthesis catalysts, such as methanol synthesis catalysts, or alcohol synthesis-functional constituents, such as methanol synthesis-functional constituents, therefore include Pd that is supported on a solid support of a metal oxide (e.g., aluminum oxide) and present in the catalyst or constituent in an amount as described herein.

For an alcohol synthesis catalyst (e.g., methanol synthesis catalyst) or an alcohol synthesis-functional constituent (e.g., methanol synthesis-functional constituent) comprising one or more of Cu, Zn, Al, Pt, Pd, and Cr, regardless of their particular form(s), such metal(s) may be present independently in an amount, in the respective alcohol synthesis catalyst (e.g., methanol synthesis catalyst) or bi-functional catalyst, generally from about 0.5 wt-% to about 45 wt-%, typically from about 1 wt-% to about 20 wt-%, and often from about 1 wt-% to about 10 wt-%, relative to the weight of the alcohol synthesis catalyst alone or the alcohol synthesis-functional constituent alone, or possibly relative to a bi-functional catalyst as a whole. In some embodiments, the metal Cu may be present, in an alcohol synthesis catalyst or bi-functional catalyst, in an amount from about 1 wt-% to about 25 wt-%, such as from about 1 wt-% to about 15 wt-%, relative to the weight of the alcohol synthesis catalyst alone or the alcohol synthesis-functional constituent alone, or possibly relative to a bi-functional catalyst as a whole. Independently or in combination with such amounts of Cu, the metal Zn may be present, in an alcohol synthesis catalyst such as a methanol synthesis catalyst, or bi-functional catalyst, in an amount from about 1 wt-% to about 20 wt-%, such as from about 1 wt-% to about 10 wt-%, relative to the weight of the alcohol synthesis catalyst alone or the alcohol synthesis-functional constituent alone, or possibly relative to a bi-functional catalyst as a whole. Independently or in combination with such amounts of Cu and/or Zn, the metal Al may be present, in an alcohol synthesis catalyst such as a methanol synthesis catalyst, or bi-functional catalyst, in an amount from about 1 wt-% to about 30 wt-%, such as from about 5 wt-% to about 20 wt-%, relative to the weight of the alcohol synthesis catalyst alone or the alcohol synthesis-functional constituent alone, or possibly relative to a bi-functional catalyst as a whole. Independently or in combination with such amounts of Cu, Zn, and/or Al, any one or more of the metals Pt, Pd, and/or Cr may be present, in an alcohol synthesis catalyst (e.g., methanol synthesis catalyst) or bi-functional catalyst, independently in an amount, or in a combined amount, from about 0.5 wt-% to about 10 wt-%, such as from about 1 wt-% to about 5 wt-%, relative to the weight of the alcohol synthesis catalyst alone or the alcohol synthesis-functional constituent alone, or possibly relative to a bi-functional catalyst as a whole.

The alcohol synthesis catalyst (e.g., methanol synthesis catalyst) or a methanol synthesis-functional constituent may further comprise a stabilizer, such as a noble metal stabilizer (e.g., platinum) or a non-noble metal stabilizer such as yttrium (e.g., in elemental form, in the form of an oxide such as yttria or other form) and/or one or more promoters selected from the group consisting of Mn, Mg, and/or Si (e.g., independently in elemental forms, oxide forms, or other forms), in respective amounts as described above. In the case of an alcohol synthesis catalyst (e.g., methanol synthesis catalyst) or alcohol synthesis-functional constituent (e.g., methanol synthesis-functional constituent) of a bi-functional catalyst, the alcohol synthesis-active metal(s) (e.g., methanol synthesis-active metal(s)), or any forms of such metals (e.g., their respective oxide forms), and optionally any solid support, may constitute all or substantially all of the catalyst or functional constituent. For example, the alcohol synthesis-active metal(s) (e.g., methanol synthesis-active metal(s)), or any forms of such metals, and optionally any solid support, may be present in a combined amount representing at least about 90%, at least about 95%, or at least about 99%, of the total weight of the alcohol synthesis catalyst (e.g., methanol synthesis catalyst) or alcohol synthesis-functional constituent (e.g., methanol synthesis-functional constituent). In the case of an alcohol synthesis catalyst or an alcohol synthesis-functional constituent further comprising one or more stabilizers and/or one or more promoters of Mn, Mg, and/or Si, the alcohol synthesis-active metal(s), or any forms of such metals, and optionally any solid support, together with the stabilizer(s) or any forms of the stabilizer(s) (e.g., platinum, yttrium, or any of their respective forms) and/or the promoter(s) or any forms of the promoter(s), may be present in a combined amount representing at least about 90%, at least about 95%, or at least about 99%, of the total weight of the alcohol synthesis catalyst (e.g., methanol synthesis catalyst) or alcohol synthesis-functional constituent (e.g., methanol synthesis-functional constituent).

In a representative alcohol synthesis catalyst (e.g., methanol synthesis catalyst) or bi-functional catalyst, any metal(s) other than Cu, Zn, Al, Pt, Pd, and/or Cr may be present in minor amounts, may be substantially absent, or may be absent. For example, any such other metal(s) may be independently present in an amount of less than about 1 wt-%, less than about 0.1 wt-%, or even less than about 0.05 wt-%, based on the total catalyst weight. Alternatively, any two or more of such other metals may be present in a combined amount of less than about 2 wt-%, less than about 0.5 wt-%, or even less than about 0.1 wt-%, based on the total catalyst weight. According to particular embodiments, for example in the case of (i) an alcohol synthesis catalyst such as a methanol synthesis catalyst comprising a solid support, or (ii) a bi-functional catalyst comprising, as a dehydration-functional constituent, a zeolite or non-zeolitic molecular sieve, such metals other than Cu, Zn, Al, Pt, Pd, and/or Cr, and present in the amounts described above, may be, more particularly, (a) metal(s) other than Cu, Zn, Al, Pt, Pd, Cr, and Si; metal(s) other than Cu, Zn, Al, Pt, Pd, Cr, Si, Ti, Zr, Mg, Ca, and Sr; or metal(s) other than Cu, Zn, Al, Pt, Pd, Cr, Si, Ti, Zr, Mg, Ca, Sr, and Y, (b) metal(s) other than Cu, Zn, Al, Pt, Pd, Cr, Si, and P; metal(s) other than Cu, Zn, Al, Pt, Pd, Cr, Si, P, Mg, Zn, Fe, Co, Ni, and Mn; or metal(s) other than Cu, Zn, Al, Pt, Pd, Cr, Si, P, Mg, Zn, Fe, Co, Ni, Mn, and Y, or (c) metal(s) other than Cu, Zn, Al, Pt, Pd, Cr, and Y; metal(s) other than Cu, Zn, Al, Pt, Pd, Cr, Mn, Mg, and Si; or metal(s) other than Cu, Zn, Al, Pt, Pd, Cr, Y, Mn, Mg, and Si. For convenience, in these particular embodiments, Si will be considered a "metal" in terms of its contribution to an alcohol synthesis catalyst, such as a methanol synthesis catalyst, or bi-functional catalyst.

A representative dehydration catalyst or dehydration-functional constituent of a bi-functional catalyst may comprise a zeolite (zeolitic molecular sieve) or a non-zeolitic molecular sieve (zeotype). Particular zeolites or non-zeolitic molecular sieves may have a structure type selected from the group consisting of CHA, TON, FAU, FER, BEA, ERI, MFI, MEL, MTW, MWW, MOR, LTL, LTA, EMT, MAZ, MEI, AFI, and AEI, and preferably selected from one or more of CHA, TON, FAU, FER, BEA, ERI, MFI, MOR, and MEL. The structures of zeolites having these and other structure types are described, and further references are provided, in Meier, W. M, et al., *Atlas of Zeolite Structure Types,* 4th Ed., Elsevier: Boston (1996). Specific examples include SSZ-13 (CHA structure), zeolite Y (FAU structure), zeolite X (FAU structure), MCM-22 (MWW structure), zeolite beta (BEA structure), ZSM-5 (MFI structure), and ZSM-22 (TON structure), with zeolite beta and ZSM-5 being exemplary.

Non-zeolitic molecular sieves (zeotypes) include ELAPO molecular sieves which are embraced by an empirical chemical composition, on an anhydrous basis, expressed by the formula:

$$(EL_xAl_yP_z)O_2$$

wherein EL is an element selected from the group consisting of silicon, magnesium, zinc, iron, cobalt, nickel, manganese, chromium and mixtures thereof, x is the mole fraction of EL and is often at least 0.005, y is the mole fraction of aluminum and is at least 0.01, z is the mole fraction of phosphorous and is at least 0.01 and x+y+z=1. When EL is a mixture of metals, x represents the total mole fraction of such metals present. The preparation of various ELAPO molecular sieves is known, and examples of synthesis procedures and their end products may be found in U.S. Pat. No. 5,191,141 (ELAPO); U.S. Pat. No. 4,554,143 (FeAPO); U.S. Pat. No. 4,440,871 (SAPO); U.S. Pat. No. 4,853,197 (MAPO, MnAPO, ZnAPO, CoAPO); U.S. Pat. No. 4,793,984 (CAPO); U.S. Pat. Nos. 4,752,651 and 4,310,440. Preferred ELAPO molecular sieves are SAPO and ALPO molecular sieves. Generally, the ELAPO molecular sieves are synthesized by hydrothermal crystallization from a reaction mixture containing reactive sources of EL, aluminum, phosphorus and a templating agent. Reactive sources of EL are the metal salts of EL elements defined above, such as their chloride or nitrate salts. When EL is silicon, a preferred source is fumed, colloidal or precipitated silica. Preferred reactive sources of aluminum and phosphorus are pseudo-boehmite alumina and phosphoric acid. Preferred templating agents are amines and quaternary ammonium compounds. An especially preferred templating agent is tetraethylammonium hydroxide (TEAOH).

A particularly preferred dehydration catalyst or dehydration-functional constituent comprises an ELAPO molecular sieve in which EL is silicon, with such molecular sieve being referred to in the art as a SAPO (silicoaluminophosphate) molecular sieve. In addition to those described in U.S. Pat. Nos. 4,440,871 and 5,191,141, noted above, other SAPO molecular sieves that may be used are described in U.S. Pat. No. 5,126,308. Of the specific crystallographic structures described in U.S. Pat. No. 4,440,871, SAPO-34, i.e., structure type 34, represents a preferred component of an LPG synthesis catalyst system. The SAPO-34 structure (CHA structure) is characterized in that it adsorbs xenon but does not adsorb iso-butane, indicating that it has a pore opening of about 4.2 Å. Accordingly, a representative dehydration catalyst or dehydration-functional constituent of a bi-functional catalyst may comprise SAPO-34 or other SAPO molecular sieve, such as SAPO-17, which is likewise disclosed in U.S. Pat. No. 4,440,871 and has a structure characterized in that it adsorbs oxygen, hexane, and water but does not adsorb iso-butane, indicative of a pore opening of greater than about 4.3 Å and less than about 5.0 Å. Due to its acidity, SAPO-34 can catalyze the conversion of an alcohol intermediate, such as a methanol intermediate, to olefins such as propylene. Without being bound by theory, it is believed that the characteristic hydrogen partial pressures used in the LPG synthesis stage not only promote the hydrogenation of these olefins, but also stabilize the dehydration catalyst/functional constituent by preventing coking. According to particular embodiments, the dehydration catalyst or dehydration-functional constituent may comprise a zeolite (zeolitic molecular sieve) of ZSM-5 or SSZ-13 or a non-zeolitic molecular sieve (zeotype) of SAPO-34 or SAPO-17. With respect to any particular zeolite or non-zeolitic molecular sieve that is used in an LPG synthesis catalyst system described herein, this may be present in any form according to which ion exchange sites are in their hydrogen form or otherwise exchanged with a suitable cation, non-limiting examples of which are cations of alkali metals (e.g., $Na^+$), cations of alkaline earth metals (e.g., $Ca^{+2}$), and ammonium cation ($NH_4^+$). For example, as a zeolite, hydrogen form SSZ-13 (HSSZ-13) may be used; as a non-zeolitic molecular sieve, hydrogen form SAPO-34 (HSAPO-34) may be used.

In the case of the dehydration catalyst or dehydration-functional constituent comprising a zeolite or a non-zeolitic molecular sieve, such catalyst or functional constituent may be more particularly defined as a solid acid dehydration catalyst or solid acid dehydration-functional constituent, on the basis of the acidity exhibited by the zeolite or non-zeolitic molecular sieve. The acidity of a given zeolite or non-zeolitic molecular sieve may be determined, for example, by temperature programmed desorption (TPD) of a quantity of ammonia (ammonia TPD), from an ammonia-saturated sample of the material, over a temperature from 275° C. (527° F.) to 500° C. (932° F.), which is beyond the temperature at which the ammonia is physisorbed. The quantity of acid sites, in units of micromoles of acid sites per gram (mol/g) of material, therefore corresponds to the number of micromoles of ammonia that is desorbed per gram of material in this temperature range. Alternatively, acidity may be calculated from, or based on, framework cation concentration of the zeolite or non-zeolitic molecular sieve. For example, in the particular case of the zeolite silicalite having a framework silica to alumina ($SiO_2/Al_2O_3$) molar framework ratio of 2000:1 (i.e., an Si/Al molar ratio of 1000:1), this would correspond to 16.6 mol/g of acid sites, on the basis of the concentration of $Al^{+3}$ cations. According to the TPD analysis above, in the absence of oligomerization, one $NH_3$ molecule would theoretically be absorbed per acid site or $Al^{+3}$ cation in the above example. A representative zeolitic or non-zeolitic molecular sieve, or otherwise a representative dehydration catalyst or dehydration-functional constituent, has at least about 15 mol/g (e.g., from about 15 to about 75 mol/g) of acid sites, or at least about 25 mol/g (e.g., from about 25 to about 65 mol/g) of acid sites, measured by ammonia TPD or otherwise based on framework cation concentration. As noted above, in the case of zeolitic molecular sieves, acidity is a function of the silica to alumina ($SiO_2/Al_2O_3$) molar framework ratio, and, in embodiments in which the dehydration catalyst or dehydration-functional constituent comprises a zeolitic molecular sieve, its silica to alumina molar framework ratio may be less than about 2400 (e.g., from about 1 to about 2400), less than about 1000 (e.g., from about 1 to about 1000), less than about 400 (e.g., from about 1 to about 400), less than about 60 (e.g., from about 1 to about 60), or less than about 40 (e.g., from about 5 to about 40).

According to preferred embodiments, a dehydration catalyst (ATLPG catalyst, such as an MTLPG catalyst) or a dehydration-functional constituent (ATLPG-functional constituent, such as an MTLPG-functional constituent) may comprise one or more stabilizers such as a noble metal (e.g., platinum) or a non-noble metal (e.g., yttrium) in elemental form, in the form of an oxide or other form on a solid acid support comprising a zeolite or non-zeolitic molecular sieve. For example, the stabilizer(s) (e.g., platinum and/or yttrium) in elemental form or in a compound form may be dispersed uniformly or non-uniformly on such solid acid support. In the case of the dehydration catalyst or dehydration-functional constituent comprising a zeolite or a non-zeolitic molecular sieve, a stabilizer may be present in ion-exchange sites thereof, i.e., the dehydration catalyst or dehydration-functional constituent may comprise an ion-exchanged zeolite or an ion-exchanged non-zeolitic molecular sieve, having been prepared by ion-exchange to achieve a desired distribution of the stabilizer(s), such as a preferred distribution of a noble metal (e.g., platinum), within the zeolite or non-zeolitic molecular sieve. Regardless of the particular manner in which they are distributed, the stabilizer(s) (e.g., platinum and/or yttrium) may be present in such ATLPG catalyst (e.g., MTLPG catalyst) or ATLPG-functional constituent (e.g., MTLPG-functional constituent) in an amount, or a combined amount, as described herein, such as from about 0.03 wt-% to about 15 wt-%, based on the weight of the stabilizer(s), relative to the weight of the catalyst or functional constituent. Optionally, such catalyst or functional constituent may further comprise one or more promoters selected from the group consisting of manganese (Mn), magnesium (Mg), and silicon (Si), with these promoter(s) being independently in elemental form or a compound form, for example in their respective oxide forms of manganese oxide ($MnO_2$), magnesium oxide (MgO), and/or silica ($SiO_2$).

Other than zeolitic and/or non-zeolitic molecular sieves, representative dehydration catalysts or dehydration-functional constituents may comprise one or more metal oxides, for example those selected from the group consisting of aluminum oxide, silicon oxide, titanium oxide, zirconium oxide, magnesium oxide, calcium oxide, iron oxide, vanadium oxide, chromium oxide, nickel oxide, tungsten oxide, and strontium oxide. Such metal oxides may serve as a binder to provide a structured dehydration catalyst or dehydration-functional constituent, and these metal oxides may, more particularly, serve as a binder for the zeolitic and/or non-zeolitic molecular sieve, if used to form the dehydration catalyst or dehydration-functional constituent. In representative embodiments, the dehydration catalyst or dehydration-functional constituent may comprise (a) a single type of zeolitic molecular sieve or (b) a single type of non-zeolitic molecular sieve, with (a) or (b) optionally being in combination with (c) a single type of metal oxide. In this case, (a) or (b), and optionally (c), may be present in an amount, or optionally a combined amount, of greater than about 75 wt-% (e.g., from about 75 wt-% to about 99.9 wt-%) or greater than about 90 wt-% (e.g., from about 90 wt-% to about 99 wt-%), based on the weight of the dehydration catalyst or dehydration-functional constituent. For example, according to more particular embodiments, (a) or (b) alone may be present in these representative amounts. According to any embodiments in which dehydration catalysts or dehydration-functional constituents are described herein as comprising a zeolitic or non-zeolitic molecular sieve, in further embodiments such zeolitic or non-zeolitic molecular sieve may be replaced, all or in part, by one or more heteropoly acids, such as those having a Keggin or Dawson structure comprising tungsten, molybdenum, and/or vanadium. That is, representative dehydration catalysts or dehydration-functional constituents may comprise a heteropoly acid in the same manner (e.g., in the same weight percentages and/or weight ratios) as described herein with respect to such dehydration catalysts or dehydration-functional constituents comprising a zeolitic or non-zeolitic molecular sieve.

The dehydration catalyst or a dehydration-functional constituent may further comprise one or more noble metal stabilizers or non-noble metal stabilizers (e.g., in elemental form, in the form of and oxide or other form) and/or one or more promoters selected from the group consisting of Mn, Mg, and/or Si (e.g., independently in elemental forms, oxide forms, or other forms), in respective amounts as described above. In general, in the case of a dehydration catalyst or dehydration-functional constituent of a bi-functional catalyst, the zeolitic and/or non-zeolitic molecular sieve(s), together with optionally one or more metal oxides as described above, stabilizers such as platinum or yttrium (e.g., in elemental form, in the form of an oxide or other form), and/or one or more promoters selected from the group consisting of manganese (Mn), magnesium (Mg), and silicon (Si) (e.g., independently in elemental forms, oxide forms, or other forms), may be present in a combined amount representing at least about 90%, at least about 95%, or at least about 99%, of the total weight of the dehydration catalyst or dehydration-functional constituent.

In the case of the dehydration catalyst or dehydration-functional constituent comprising a zeolite or a non-zeolitic molecular sieve, the zeolite or non-zeolitic molecular sieve may provide a solid support for components of this catalyst or functional constituent, such as one or more stabilizers and/or one or more promoters as described herein. For example, such stabilizer(s) and/or promoter(s) may be incorporated in the zeolite or non-zeolitic molecular sieve, acting as a solid support, according to various techniques for catalyst preparation, including sublimation, impregnation, or dry mixing. In the case of impregnation, an impregnation solution of soluble compounds of the one or more stabilizers and/or one or more promoters in a polar (aqueous) or non-polar (e.g., organic) solvent may be contacted with the solid support, preferably under an inert atmosphere. For example, this contacting may be carried out, preferably with stirring, in a surrounding atmosphere of nitrogen, argon, and/or helium, or otherwise in a non-inert atmosphere, such as air. The solvent may then be evaporated from the solid support, for example using heating, flowing gas, and/or vacuum conditions, leaving the dried, solid support comprising the zeolite or non-zeolitic molecular sieve and being impregnated with the stabilizer(s) and/or promoter(s). These components may be impregnated in the solid support, such as in the case of a plurality of metals (e.g., one or more stabilizers and one or more promoters, or otherwise two or more stabilizers or two or more promoters) being impregnated simultaneously by being dissolved in the same impregnation solution, or otherwise being impregnated separately using different impregnation solutions and contacting steps. In any event, the zeolite or non-zeolitic molecular sieve, acting as the solid support for impregnated stabilizer(s) and/or promoter(s) may be subjected to further preparation steps, such as washing with the solvent to remove excess metal(s) and impurities, further drying, calcination, etc. to provide the dehydration catalyst or dehydration-functional constituent. For incorporating any of a number of possible cations within a zeolite or non-zeolitic molecular sieve, as a component of a dehydration catalyst or dehydration-functional constituent, the technique of ion-exchange may be used. In this case, the support material is immersed in a solution of a cation, different from that already present in the exchange sites of the zeolite or non-zeolitic molecular sieve, such that these solution cations replace (exchange with) these exchange site cations, up to an equilibrium extent, which is governed by the particular conditions of the ion-exchange. The zeolite or non-zeolitic molecular sieve can then be washed to remove all ionic species that are not electrostatically bound to heteroatom exchange sites within the pores of the support material.

In yet further embodiments, regardless of the particular manner in which metals are incorporated/supported, as an alternative to supporting stabilizer(s) and/or promoter(s), or in addition to supporting stabilizer(s) and/or promoter(s), the zeolite or non-zeolitic molecular sieve may support one or more transition metals (e.g., one or more of Pt, Pd, Rh, Ir, and/or Au) in elemental form or in a compound form. Such one or more transition metals may be present in an amount, or combined amount, from about 0.05 wt-% to about 5 wt-%, such as from about 0.1 wt-% to about 3 wt-%, based on the weight of the transition metal(s), relative to the weight of the dehydration catalyst or dehydration-functional constituent comprising the zeolite or non-zeolitic molecular sieve. In the case of such transition metals being Pt and/or Pd, these may also be considered noble metal stabilizers. In still further embodiments, as an alternative to supporting stabilizer(s), promoter(s), and/or transition metal(s) or in addition to supporting stabilizer(s), promoter(s), and/or transition metal(s), the zeolite or non-zeolitic molecular sieve may support one or more surface-modifying agents (e.g., one or more of Si, Na, and/or Mg) in elemental form or in a compound form. Any surface-modifying agents, which by definition are disposed predominantly or completely on an external surface of the zeolite or non-zeolitic molecular sieve, may be present in an amount, or combined amount, from about 0.05 wt-% to about 5 wt-%, such as from about 0.1 wt-% to about 3 wt-%, based on the weight of the surface-modifying agent(s), relative to the weight of the dehydration catalyst or dehydration-functional constituent comprising the zeolite or non-zeolitic molecular sieve. In contrast to surface-modifying agents, any of the stabilizer(s), promoter(s), and/or transition metal(s) may be disposed uniformly throughout the zeolite or non-zeolitic molecular sieve used as a component of a dehydration catalyst or dehydration-functional constituent, or may be disposed according to any other profile (e.g., radial concentration profile), such as predominantly or completely on an external surface of the zeolite or non-zeolitic molecular sieve, or otherwise predominantly or completely within internal pores of such zeolite or non-zeolitic molecular sieve.

Those skilled in the art having knowledge of the present disclosure, including the general catalyst preparation procedures described above, will appreciate how such procedures can be adapted to obtain loadings of components (e.g., stabilizer(s), promoter(s), and/or transition metal(s)) with a desired profile, such as in the case of being concentrated near the external surface of, concentrated within internal pores of, or disposed uniformly throughout, a zeolite or non-zeolitic molecular sieve, with the desired profile likewise being applicable to the dehydration catalyst or dehydration-functional constituent as a whole. For example, an impregnation solution may be contacted with a powder form, or other finely divided form, of the zeolite or non-zeolitic molecular sieve to obtain a uniform distribution. Otherwise, in the case of using any one or more of the metal oxides described above as a binder for the zeolite or non-zeolitic molecular sieve, an impregnation solution may be contacted with larger, structured forms of the bound zeolite or non-zeolitic molecular sieve (e.g., having dimensions equivalent to, or on the same order as, the dehydration catalyst or dehydration-functional constituent as a whole) to obtain distributions of components preferentially near the external surface of the zeolite or non-zeolitic molecular sieve, or otherwise the dehydration catalyst or dehydration-functional constituent. The use of ion-exchange provides an effective method for incorporating stabilizers described herein (e.g., platinum) and other metals into a zeolite or non-zeolitic molecular sieve support material with a desirable distribution. An important characteristic of ion-exchange is the ability of this technique to deposit active metals as single (atomic) cations and at specific sites on the catalyst, namely those sites with a charge imbalance resulting from a heteroatom such as Al. The deposited metal is therefore atomically dispersed and present in a limited number of specific coordination environments.

In a representative dehydration catalyst or bi-functional catalyst, any metal(s) other than (a) Pt and/or Y (optionally together with any one or more other metals selected from Group 3 or Group 4 of the Periodic Table, and/or one or more lanthanides) and/or (b) metal(s) present in the zeolitic and/or non-zeolitic molecular sieve(s) and optionally one or more metal oxides as described above, may be present in minor amounts, may be substantially absent, or may be absent. For example, any such metal(s) other than (a) and/or (b) may be independently present in an amount of less than about 1 wt-%, less than about 0.1 wt-%, or even less than about 0.05 wt-%, based on the total catalyst weight. Alternatively, any two or more of such other metals may be present in a combined amount of less than about 2 wt-%, less than about 0.5 wt-%, or even less than about 0.1 wt-%, based on the total catalyst weight. According to particular embodiments, a dehydration catalyst or bi-functional catalyst may comprise metal(s) other than Pt and/or Y (optionally together with any one or more other metals selected from Group 3 or Group 4 of the Periodic Table, and/or one or more lanthanides), Mn, and/or Mg in the amounts described above; metals other than Pt and/or Y (optionally together with any one or more other metals selected from Group 3 or Group 4 of the Periodic Table, and/or one or more lanthanides), Mn, Mg, and/or Si in the amounts described above; metals other than Pt and/or Y (optionally together with any one or more other metals selected from Group 3 or Group 4 of the Periodic Table, and/or one or more lanthanides), Mn, Mg, Si, and/or P in the amounts described above; metals other than Pt and/or Y (optionally together with any one or more other metals selected from Group 3 or Group 4 of the Periodic Table, and/or one or more lanthanides), Mn, Mg, Si, P, Zn, Co, and/or Fe in the amounts described above; metals other than Pt and/or Y (optionally together with any one or more other metals selected from Group 3 or Group 4 of the Periodic Table, and/or one or more lanthanides), Mn, Mg, Si, P, Zn, Co, Fe, Al, Ti, Zr, Mg, and/or Ca in the amounts described above; or metals other than Pt and/or Y (optionally together with any one or more other metals selected from Group 3 or Group 4 of the Periodic Table, and/or one or more lanthanides), Mn, Mg, Si, P, Zn, Co, Fe, Al, Ti, Zr, Mg, Ca, V, Cr, Ni, W, and/or Sr in the amounts described above. For convenience, in these particular embodiments, Si and P will be considered "metals" in terms of their contributions to a dehydration catalyst or bi-functional catalyst. Other components of an alcohol synthesis catalyst (e.g., a methanol synthesis catalyst), a dehydration catalyst, or a bi-functional catalyst as described herein, such as binders (e.g., one or more metal oxides as described herein) and other additives, may be present in minor amounts, such as in an amount, or combined amount, of less than about 10 wt-% (e.g., from about 0.01 wt-% to about 10 wt-%), less than about 5 wt-% (e.g., from about 0.01 wt-% to about 10 wt-%), or less than about 1 wt-% (e.g., from about 0.01 wt-% to about 10 wt-%), based on the weight of the catalyst.

In the case of LPG synthesis catalyst systems comprising separate compositions of two different catalyst types, components of an alcohol synthesis catalyst (e.g., a methanol synthesis catalyst) as described herein may be substantially absent, or absent, from a dehydration catalyst. In the same manner, components of a dehydration catalyst as described herein may be substantially absent, or absent, from an alcohol synthesis catalyst (e.g., a methanol synthesis catalyst). For example, a representative dehydration catalyst may comprise (a) one or more alcohol synthesis-active metals (e.g., methanol synthesis-active metals(s)) described herein, (b) a solid support as described herein, (c) one or more stabilizers such as platinum and/or yttrium, and/or (d) one or more promoters of Mn, Mg, and/or Si, in an amount of (a), (b), (c), and/or (d), such as in a combined amount of (a), (b), (c), and (d), of less than about 5 wt-%, less than about 1 wt-%, or less than about 0.1 wt-%. This applies to dehydration catalysts generally, but this may also apply, more particularly, to dehydration catalysts of catalyst systems in which the alcohol synthesis catalyst (e.g., methanol synthesis catalyst) comprises, respectively, (a), (b), (c), and/or (d). For example, in the case of an alcohol synthesis catalyst (e.g., methanol synthesis catalyst) comprising (a) one or more alcohol synthesis-active metal(s) (e.g., methanol synthesis-active metals(s)), a dehydration catalyst of a catalyst system comprising that alcohol synthesis catalyst (e.g., methanol synthesis catalyst) may comprise such (a) one or more alcohol synthesis-active metal(s) (e.g., methanol synthesis-active metals(s)) in an amount, or combined amount, as described above (e.g., in an amount, or combined amount, of less than about 0.1 wt-%). Similarly, in the case of an alcohol synthesis catalyst (e.g., methanol synthesis catalyst) comprising (b), (c), and/or (d), a dehydration catalyst of a catalyst system comprising that alcohol synthesis catalyst (e.g., methanol synthesis catalyst) may comprise such respective (b), (c), and/or (d) in an amount, or combined amount, as described above. Alternatively, or in combination, a representative alcohol synthesis catalyst (e.g., methanol synthesis catalyst) may comprise (a) one or more zeolitic and/or non-zeolitic molecular sieve(s), (b) one or more metal oxides as described above, (c) one or more stabilizers such as platinum and/or yttrium, (d) one or more promoters of Mn, Mg, and/or Si, (e) one or more transition metals (e.g., Pt, Pd, Rh, Ir, and/or Au), and/or (f) one or more surface-modifying agents (e.g., Si, Na, and/or Mg) in an amount of (a), (b), (c), (d), (e), and/or (f) such as in a combined amount of (a), (b), (c), (d), (e), and/or (f) of less than about 5 wt-%, less than about 1 wt-%, or less than about 0.1 wt-%. This applies to alcohol synthesis catalysts (e.g., methanol synthesis catalysts) generally, but this may also apply, more particularly, to alcohol synthesis catalysts (e.g., methanol synthesis catalysts) of catalyst systems in which the dehydration catalyst comprises, respectively, (a), (b), (c), (d), (e), and/or (f). For example, in the case of a dehydration catalyst comprising (a) one or more zeolitic and/or non-zeolitic molecular sieve(s), an alcohol synthesis catalyst (e.g., methanol synthesis catalyst) of a catalyst system comprising that dehydration catalyst may comprise such (a) one or more zeolitic and/or non-zeolitic molecular sieve(s) in an amount, or combined amount, as described above (e.g., in an amount, or combined amount, of less than about 0.1 wt-%). Similarly, in the case of a dehydration catalyst comprising (b), (c), (d), (e), and/or (f), a methanol synthesis catalyst of a catalyst system comprising that dehydration catalyst may comprise such respective (b), (c), (d), (e), and/or (f) in an amount, or combined amount, as described above.

As an alternative to separate compositions of two different catalyst types, LPG synthesis may be performed using a single catalyst composition, namely a bi-functional catalyst comprising both an alcohol synthesis-functional constituent (e.g., methanol synthesis-functional constituent) and a dehydration-functional constituent. In terms of the compositions of these constituents, they may correspond in isolation to an alcohol synthesis catalyst (e.g., a methanol synthesis catalyst) and a dehydration catalyst, respectively, as described herein. When combined in a single catalyst composition, the functional constituents (i) and (ii) may be present in weight ratios as described herein. A representative bi-functional catalyst may therefore comprise (i) an alcohol synthesis-functional constituent (e.g., methanol synthesis-functional constituent) comprising one or more alcohol synthesis-active metals (e.g., methanol synthesis-active metals) as described above, and optionally a solid support as described herein, and (ii) a dehydration-functional constituent comprising a zeolite or non-zeolitic molecular sieve, and optionally a metal oxide, one or more transition metals, and/or one or more surface-modifying agents, as described herein. Either (i) or (ii) may further comprise a stabilizer, such as a noble metal stabilizer (e.g., platinum) or a non-noble metal stabilizer such as yttrium (e.g., in elemental form, in the form of an oxide such as yttria or other form) and/or one or more promoters selected from the group consisting of Mn, Mg, and/or Si (e.g., independently in elemental forms, oxide forms, or other forms).

It can be appreciated from the above description, including the weight ratios in which (i) and (ii) may be combined, that the one or more alcohol synthesis-active metals (e.g., methanol synthesis-active metals) may be present in a bi-functional catalyst as a whole, in an amount, or combined amounts, that is/are less than that/those amounts in which they are present in an alcohol synthesis catalyst (e.g., methanol synthesis catalyst), as described above. Likewise, the zeolite or non-zeolitic molecular sieve may be present in a bi-functional catalyst as a whole, in an amount that is less than that in which it is present in a dehydration catalyst, as described above. For example, a bi-functional catalyst as a whole may comprise the one or more alcohol synthesis-active metals (e.g., methanol synthesis-active metals) in lower amount, such as independently in an amount generally from about 0.2 wt-% to about 30 wt-%, typically from about 0.5 wt-% to about 15 wt-%, and often from about 0.8 wt-% to about 5 wt-%, based on the weight of the bi-functional catalyst. Likewise, a bi-functional catalyst as a whole may comprise (a) a single type of zeolitic molecular sieve or (b) a single type of non-zeolitic molecular sieve, with (a) or (b) optionally being in combination with (c) a single type of metal oxide. In this case, (a) or (b), and optionally (c), may be present in an amount, or optionally a combined amount, of greater than about 35 wt-% (e.g., from about 35 wt-% to about 95 wt-%), greater than about 50 wt-% (e.g., from about 50 wt-% to about 90 wt-%), or greater than about 75 wt-% (e.g., from about 75 wt-% to about 85 wt-%), based on the weight of the bi-functional catalyst. For example, according to more particular embodiments, (a) or (b) alone may be present in these representative amounts. Further in view of the above description, based on the weight of one or more stabilizers such as platinum and/or yttrium, and, relative to the weight of a bi-functional catalyst as a whole, the one or more stabilizers such as platinum and/or yttrium (e.g., in elemental form, in the form of an oxide or other form)

may be present in an amount from about 0.01 wt-% to about 10 wt-%, such as from about 0.05 wt-% to about 6 wt-% or from about 0.1 wt-% to about 1 wt-%. Based on the weight of Mn, Mg, and/or Si, and, relative to the weight of the bi-functional catalyst as a whole, the promoter(s) (e.g., independently in elemental forms, oxide forms, or other forms) may be present in an amount from about 0.05 wt-% to about 12 wt-%, such as from about 0.1 wt-% to about 10 wt-% or from about 0.5 wt-% to about 8 wt-%.

Representative bi-functional catalysts may therefore comprise: (i) as an alcohol synthesis-functional constituent (e.g., methanol synthesis-functional constituent), one or more alcohol synthesis-active metals (e.g., methanol synthesis-active metal(s)), or any forms of such metals (e.g., elemental and/or oxide forms), as described herein, and optionally any solid support as described herein, and (ii) as a dehydration-functional constituent, one or more zeolitic and/or non-zeolitic molecular sieve(s) as described herein, and optionally one or more metal oxides, one or more transition metals, and/or one or more surface-modifying agents, as described herein. Such bi-functional catalyst may further comprise, for example as component(s) of either the alcohol synthesis-functional constituent (e.g., methanol synthesis-functional constituent) and/or the dehydration-functional constituent, a stabilizer such as platinum and/or yttrium (e.g., in elemental form, in the form of an oxide or other form), and/or one or more promoters of Mn, Mg, and/or Si (e.g., independently in elemental forms, oxide forms, or other forms). The one or more alcohol synthesis-active metals (e.g., methanol synthesis-active metal(s)), or any forms of such metals (e.g., elemental and/or oxide forms), one or more zeolitic and/or non-zeolitic molecular sieve(s), together with any optional solid support, optional metal oxide(s), optional transition metal(s), optional surface-modifying agent(s), stabilizers, such as a noble metal stabilizer (e.g., platinum) or a non-noble metal stabilizer such as yttrium (e.g., in elemental form, in the form of an oxide such as yttria or other form), and/or one or more promoters of Mn, Mg, and/or Si (e.g., independently in elemental forms, oxide forms, or other forms), may constitute all or substantially all of the bi-functional catalyst, for example these components may be present in a combined amount representing at least about 90%, at least about 95%, or at least about 99%, of the total weight of the bi-functional catalyst.

EXAMPLES

The following examples are set forth as representative of the present invention. These examples are not to be construed as limiting the scope of the invention as other equivalent embodiments will be apparent in view of the present disclosure and appended claims.

An LPG synthesis catalyst system with 450 grams of a bi-functional catalyst, in the form of extrudates (cylinders), having approximately 32 wt-% of a methanol synthesis-functional constituent, 48 wt-% of a dehydration-functional constituent, and 20 wt-% of an alumina binder, was tested for conversion of a synthesis gas at 2.1 MPa (300 psig) gauge pressure and a temperature of 305° C. (581° F.) in the LPG synthesis reactor containing this bi-functional catalyst. The methanol synthesis-functional constituent was Cu/ZnO/$Al_2O_3$ and the dehydration-functional constituent was zeolite beta (Si/Al=19) having Pt supported thereon. The process used for this testing had a configuration according to FIG. 2, including a cooler and downstream of the LPG synthesis reactor and water knockout vessel for removing condensed water. A portion, i.e., a recycle portion, of the water-depleted or dried LPG synthesis effluent was returned to the reactor and another portion was withdrawn for analysis of the reaction products. The recycle line, from the point of separation of the recycle portion of the LPG synthesis effluent from the withdrawn portion to the point of combining with the fresh makeup feed, included a recycle compressor with upstream and downstream buffers, or dampeners, was well as a mass flow meter. The process configuration was therefore suitable for evaluating the effects of removing water (steam) from the LPG production process by cooling and condensing the LPG synthesis effluent, and recycling a portion of the dried gas.

According to the experiments performed, a standard flow rate of 1 standard liter per minute (SL/M) was used for the fresh makeup feed, and various values of the recycle ratio R of (i) the water-depleted (dried) recycle portion of the LPG synthesis effluent to (ii) fresh makeup feed were tested. For example, (i) at R=0, only 1 SL/M of fresh makeup feed, corresponding in this case to the synthesis gas feed, was passed through the bed of catalyst, and (ii) at R=3, 1 SL/M of fresh makeup feed and 3 SL/M of the dried recycle gas, for a total flow of 4 SL/M of the synthesis gas feed, were passed through the bed of catalyst. Between 0 and 280 hours on stream (HOS), i.e., at a time on stream (TOS)=0-280, the composition of the synthesis gas feed was that of a "simulated recycle" operation, having approximately 20 mol-% CO, 18 mol-% $CO_2$, 57% mol-% $H_2$, and 5 mol-% $N_2$. After 280 hours on stream (HOS), the composition of the fresh makeup feed, which was combined with dried recycle gas upstream of the LPG synthesis reactor, was approximately 26 mol-% CO, 7 mol-% $CO_2$, 63 mol-% $H_2$, and 4 mol-% $N_2$.

Figure 5:
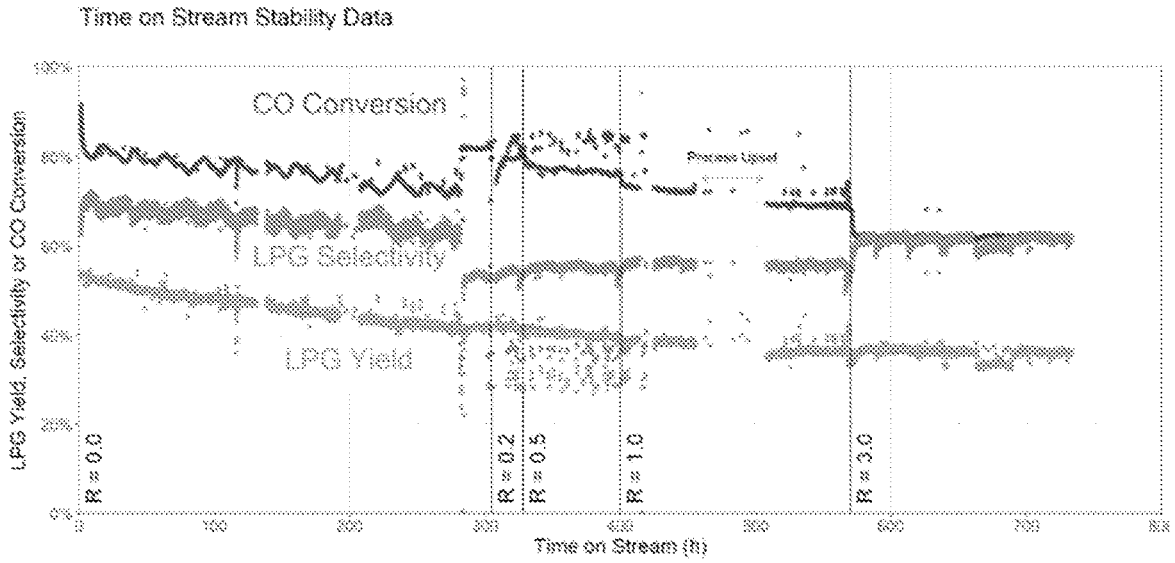
FIG. 5. illustrates that various performance parameters, namely CO conversion, LPG hydrocarbon yield, LPG hydrocarbon selectivity, and LPG synthesis catalyst system stability, may be improved by increasing the recycle ratio, determined as the ratio of volumetric or molar flow rates of (i) a water-depleted recycle portion of the LPG synthesis effluent, back to the LPG synthesis stage, to (ii) the fresh makeup feed. In this case, the water-depleted recycle portion was obtained as a portion of the LPG synthesis effluent having been subjected to water removal.
Figure 6:
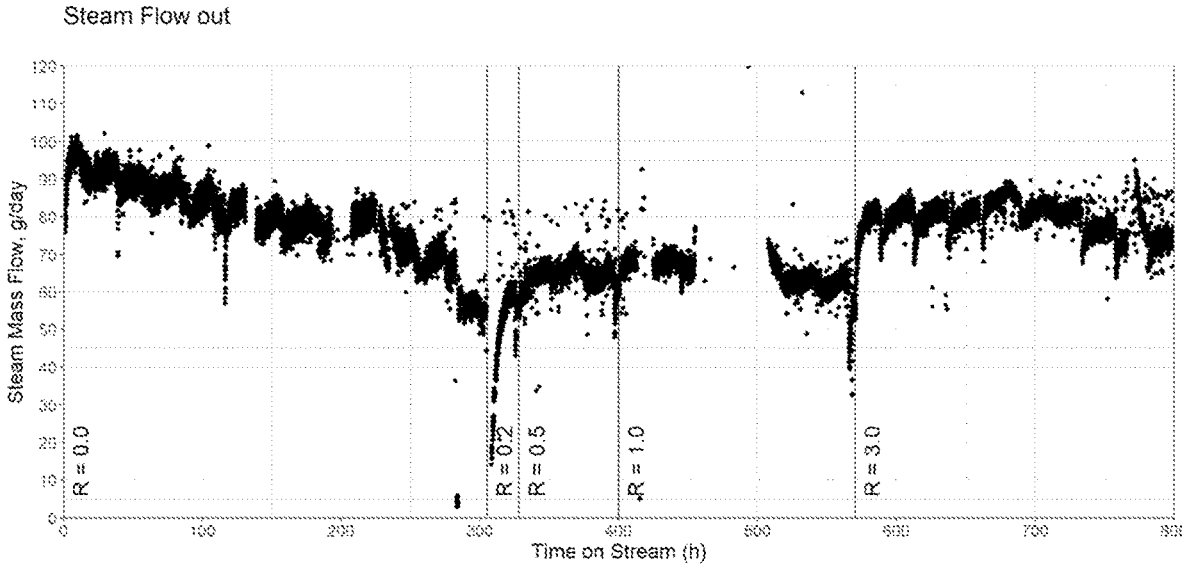
FIG. 6 illustrates the extent to which the total $H_2O$ (steam) flow out of the LPG synthesis reactor varies with adjustments to the recycle ratio, as determined above with respect to FIG. 5.
Figure 7:
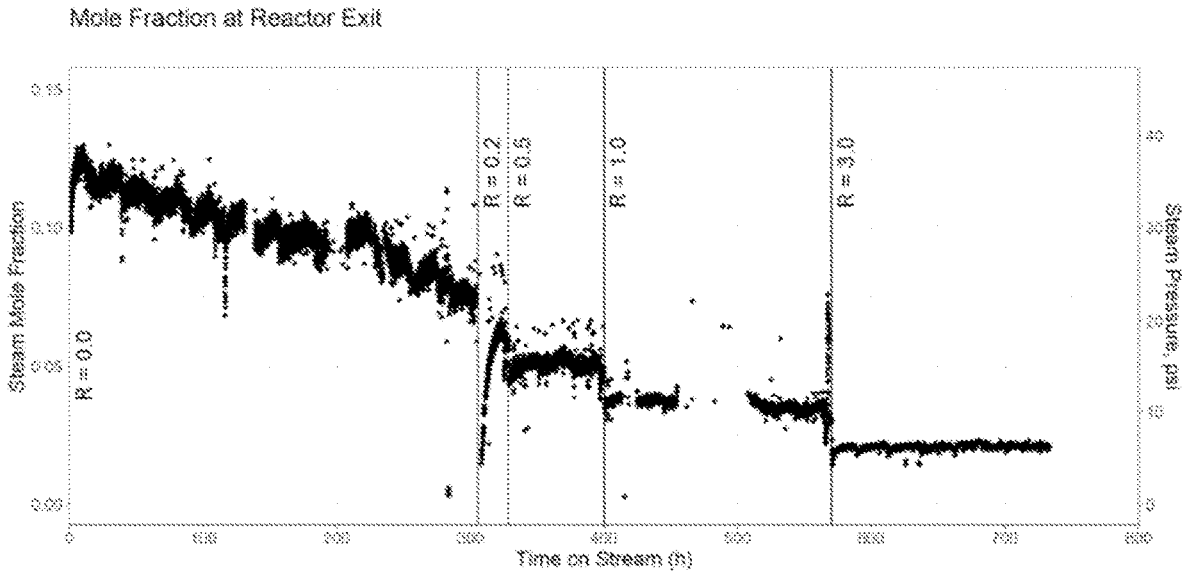
FIG. 7 illustrates, in the LPG synthesis reactor and LPG synthesis effluent, the extent to which the $H_2O$ (steam) mole fraction, or mol %, as well as the $H_2O$ (steam) partial pressure, vary with adjustments to the recycle ratio, as determined above with respect to FIG. 5.
Figure 8:
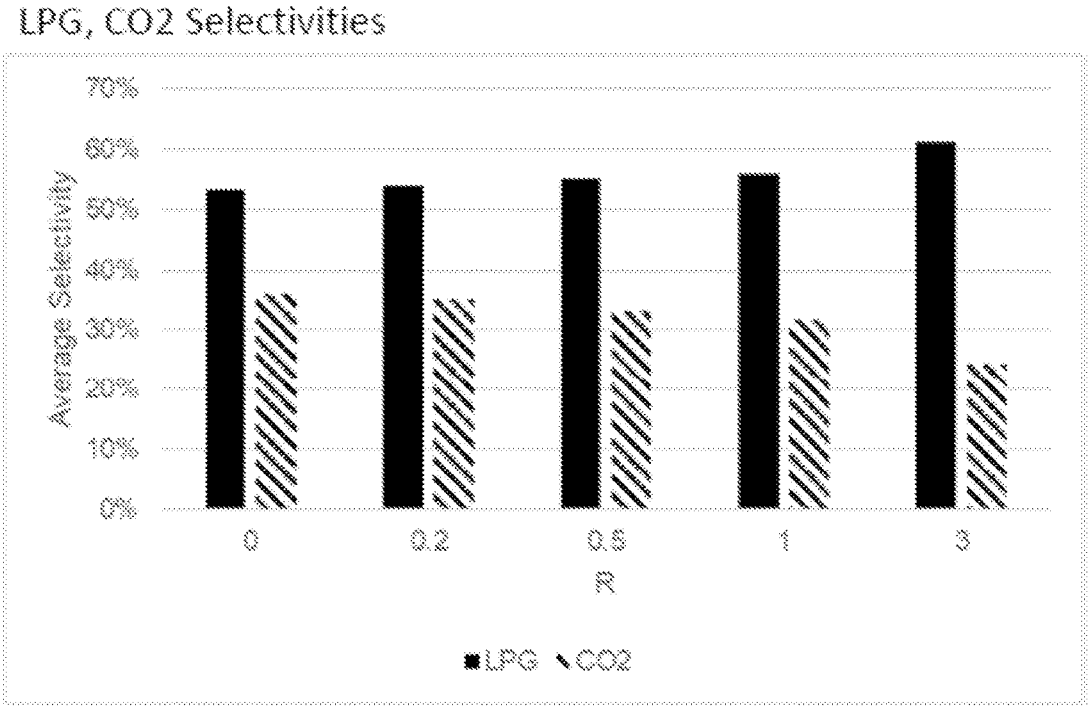
FIG. 8 illustrates, in bar graph format, that the performance parameter of LPG hydrocarbon selectivity may be improved as the recycle ratio, as determined above with respect to FIG. 5, is increased. Also illustrated is the decrease in the non-selective conversion of CO to $CO_2$, namely the decrease in $CO_2$ selectivity, as this recycle ratio is increased.

As the recycle ratio R was increased, the following were observed: (1) the rate of undesirable conversion of CO (+water) to $CO_2$ (+$H_2$) decreased; (2) the average $H_2O$ vapor pressure or partial pressure decreased; and (3) the LPG synthesis catalyst system stability increased. Importantly, the rate of LPG formation/LPG yield remained approximately unchanged, even at R=3. Various performance parameters and other process criteria, as impacted by the changes in R, are illustrated in FIGS. 5-8. More particularly, FIG. 5 provides the values obtained for CO conversion and LPG hydrocarbon selectivity and yield, as well as the changes in these performance parameters over time, thereby additionally providing a depiction of the catalyst stability. At the recycle ratios R that were utilized, (i) FIG. 6 provides steam ($H_2O$) flow from the LPG synthesis reactor (ii) FIG. 7 provides steam ($H_2O$) mole fraction and steam partial pressure at the LPG synthesis reactor outlet, and (iii) FIG. 8 provides LPG hydrocarbon selectivity and $CO_2$ selectivity in bar graph format.

As evidenced by these results, increasing the recycle ratio R, coupled with water removal, improves selectivity and catalyst stability, without any significant detriment to the rate of LPG production. Further benefits are evident in view of the high exothermicity of the LPG synthesis reaction and, in particular, the use of higher overall gas flow through the reactor to improve heat transfer characteristics within the bed of the LPG synthesis catalyst. Additionally, cooling the effluent gas or portion thereof, before recycling, allows for a greater proportion of the reaction heat to be removed "ex situ." This may manifest in a correspondingly lower heat transfer area requirement within the reactor, such as fewer required tubes in a multi-tubular reactor, leading, in turn, to a reduction in reactor capital cost. In the case of an adiabatic reactor with substantially no heat input from, or heat loss to, the surrounding environment, the temperature of the fluid flowing through the reactor and catalyst contacted by that fluid generally changes along the flow direction (e.g., axial direction) through the reactor, according to the heat released (from an exothermic reaction) or heat consumed (by an endothermic reaction) and the capacity of the fluid and catalyst to absorb this heat. For an exothermic reaction (such as in the case of producing LPG hydrocarbons from synthesis gas according to processes described herein), reaction heat generated in an adiabatic reactor is incorporated into the sensible heat of the fluid. The greater the mass flow of this fluid in carrying out a given level of conversion, the lower the temperature rise. Considering that recycle gas may be largely non-reactive and act substantially as a heat sink, adding such recycle gas through the reactor, with the result of a greater mass flow of fluid over the same quantity of catalyst that is used to perform the substantially same level of conversion, reduces the temperature rise across an adiabatic reactor. In this manner, recycle can be beneficial not only for removing water (e.g., in the form of steam) but also for providing an effective means of temperature control within the reactor. In some embodiments, all or substantially all generated reaction heat can be removed through gas recycle, or adjustments of this recycle, optionally in combination with other heat removal approaches, depending on the maximum allowable temperature rise (exotherm) or temperature value. By recycling gas, LPG hydrocarbons can be synthesized in an adiabatic fixed bed reactor or series of adiabatic fixed bed reactors, with interstage heat removal for additional temperature control, depending on the recycle ratio and maximum allowable temperature rise, or temperature value, within the reactor.

The positive effect of increasing the recycle ratio/decreasing the water content, on catalyst stability in particular, may be explained by certain effects of water on the LPG synthesis catalyst system. For example, high steam pressures, coupled with high reactor temperatures, can lead to sintering and crystal growth of a given alcohol synthesis-functional constituent on the alcohol synthesis catalyst in which this constituent is utilized. These phenomena, in turn, cause reductions in catalyst surface area, as well as metal (Cu)-support (ZnO, $ZrO_2$) interactions that are necessary for catalyzing methanol synthesis pathways. To counteract such detrimental effects, the removal of water can stabilize and improve the functioning of at least the methanol synthesis catalyst or catalyst constituent. Operationally, the control of water content and the extent of water removal provide important "handles" for monitoring and manipulating LPG synthesis production processes. For example, the partial pressure of water, determined at the reactor exit or elsewhere in the process, can be monitored and maintained at a sufficiently low value to avoid catalyst damage.

Overall, aspects of the invention relate to the surprising discovery that LPG production processes and associated catalyst systems can be improved and/or controlled in some respects by water removal, according to a number of possible processing alternatives. Importantly, water removal has been found to impact relevant performance parameters such as LPG hydrocarbon yield and selectivity, as well as stability of the LPG synthesis catalyst system. Those skilled in the art, having knowledge of the present disclosure, will recognize that various changes can be made to these processes, including operating conditions and LPG synthesis catalyst systems used, in attaining these and other advantages, without departing from the scope of the present disclosure. As such, it should be understood that the features of the disclosure are susceptible to modifications and/or substitutions without departing from the scope of this disclosure. The specific embodiments illustrated and described herein are for illustrative purposes only, and not limiting of the invention as set forth in the appended claims.

The invention claimed is:

1. A process for producing an LPG product comprising propane and/or butane, the process comprising:

(a) in an LPG synthesis stage, contacting a synthesis gas feed comprising $H_2$ and CO with an LPG synthesis catalyst system to produce an LPG synthesis effluent comprising the LPG product, and (b) removing a water-enriched product downstream of the LPG synthesis stage from (i) the LPG synthesis effluent, or (ii) a cooled LPG synthesis effluent, obtained by cooling the LPG synthesis effluent in a cooler, to provide a water-depleted LPG synthesis effluent comprising the LPG product, wherein a recycle portion of the water-depleted LPG synthesis effluent is returned to the LPG synthesis stage.

2. The process of claim 1, further comprising separating the LPG product from all or a portion of the water-depleted LPG synthesis effluent.

3. The process of claim 1, wherein the LPG synthesis stage comprises at least a first, upstream LPG synthesis reactor and a second, downstream LPG synthesis reactor.

4. The process of claim 1 further comprising, in a separation stage downstream of the LPG synthesis stage, separating the LPG product from a withdrawn portion of the water-depleted LPG synthesis effluent, obtained from removal of the recycle portion of the water-depleted LPG synthesis effluent.

5. The process of claim 4, wherein, in addition to the LPG product, the separation stage separates a gaseous fraction and/or a heavy byproduct fraction.

6. The process of claim 5, further comprising recycling a portion of the LPG product, or at least a portion of (i) the gaseous fraction and/or (ii) the heavy byproduct portion, to the LPG synthesis stage.

7. The process of claim 1, further comprising removing an initial water-enriched product from the synthesis gas feed, or from a fresh makeup feed.

8. The process of claim 1, wherein the water-enriched product is removed by (i) cooling and condensation, (ii) adsorptive separation, or (iii) membrane separation.

9. The process of claim 1, wherein the LPG synthesis stage comprises a fluidized bed reactor.

10. A process for producing an LPG product comprising propane and/or butane, the process comprising:

(a) in an LPG synthesis stage, contacting a synthesis gas feed comprising $H_2$ and CO with an LPG synthesis catalyst system to produce an LPG synthesis effluent comprising the LPG product, (b) obtaining a recycle portion of the LPG synthesis effluent downstream of the LPG synthesis stage, and (c) removing a water-enriched product from (i) the recycle portion of the LPG synthesis effluent, or (ii) a cooled recycle portion of the LPG synthesis effluent, obtained by cooling the recycle portion of the LPG synthesis effluent in a cooler, to provide a water-depleted recycle portion of the LPG synthesis effluent that is returned to the LPG synthesis stage.

11. The process of claim 10, further comprising separating the LPG product from a portion of the LPG synthesis effluent.

12. The process of claim 10, wherein the LPG synthesis stage comprises at least a first, upstream LPG synthesis reactor and a second, downstream LPG synthesis reactor.

13. The process of claim 10, further comprising, in a separation stage downstream of the LPG synthesis stage, separating the LPG product from a withdrawn portion of the LPG synthesis effluent, obtained from removal of the recycle portion of the LPG synthesis effluent.

14. The process of claim 13, wherein, in addition to the LPG product, the separation stage separates a gaseous fraction and/or a heavy byproduct fraction.

15. The process of claim 14, further comprising recycling a portion of the LPG product, or at least a portion of (i) the gaseous fraction and/or (ii) the heavy byproduct portion, to the LPG synthesis stage.

16. A process for producing an LPG product comprising propane and/or butane, the process comprising:

(a) in an LPG synthesis stage, contacting a synthesis gas feed comprising $H_2$ and CO with an LPG synthesis catalyst system to produce an LPG synthesis effluent comprising the LPG product, and (b) adjusting a content of water being introduced into the LPG synthesis stage, in response to a measured content of water in the process, to improve a performance parameter of the process, wherein the performance parameter is (i) a yield of, or selectivity to, LPG hydrocarbons, (ii) a stability of the LPG synthesis catalyst system, or (iii) temperature rise or maximum temperature of the LPG synthesis catalyst system.

17. The process of claim 16, further comprising separating the LPG product from all or a portion of the LPG synthesis effluent.

18. The process of claim 16, wherein the LPG synthesis stage comprises at least a first, upstream LPG synthesis reactor and a second, downstream LPG synthesis reactor.

19. A process for producing an LPG product comprising propane and/or butane, the process comprising:

(a) in an LPG synthesis stage contacting a synthesis gas feed comprising $H_2$ and CO with an LPG synthesis catalyst, system to produce an LPG synthesis effluent comprising the LPG product, and (b) adjusting a content of water in the LPG synthesis stage to improve a performance parameter of the process, wherein the adjusting of the content of water in step (b) is performed by adjusting a flow of a recycle portion of the LPG synthesis effluent, or water-depleted recycle portion of the LPG synthesis effluent, to the LPG synthesis stage, and wherein the performance parameter is (i) a yield of, or selectivity to, LPG hydrocarbons, (ii) a stability of the LPG synthesis catalyst system, or (iii) temperature rise or maximum temperature of the LPG synthesis catalyst system.

20. The process of claim 19, wherein the adjusting of the content of water in step (b) is in response to a measured content of water in the process.

* * * * *